US007426944B2

(12) United States Patent
Danby et al.

(10) Patent No.: US 7,426,944 B2
(45) Date of Patent: Sep. 23, 2008

(54) DOUBLE LAYER FORMING FABRIC WITH HIGH CENTER PLANE RESISTANCE

(75) Inventors: Roger Danby, Amprior (CA); Dale B. Johnson, Ottawa (CA); Richard Stone, Ontario (CA)

(73) Assignee: AstenJohnson, Inc., Charleston, SC (US)

( * ) Notice: Subject to any disclaimer, the term of this patent is extended or adjusted under 35 U.S.C. 154(b) by 36 days.

(21) Appl. No.: 11/575,990

(22) PCT Filed: Sep. 29, 2005

(86) PCT No.: PCT/CA2005/001473

§ 371 (c)(1),
(2), (4) Date: Mar. 26, 2007

(87) PCT Pub. No.: WO2006/034576

PCT Pub. Date: Apr. 6, 2006

(65) Prior Publication Data

US 2008/0035230 A1 Feb. 14, 2008

(30) Foreign Application Priority Data

Sep. 30, 2004 (GB) ..... 0421776.6
Sep. 30, 2004 (GB) ..... 0421779.0
Apr. 26, 2005 (GB) ..... 0508445.4

(51) Int. Cl.
*D21F 7/08* (2006.01)
*D03D 25/00* (2006.01)

(52) U.S. Cl. ..... 139/383 A; 139/383 AA; 162/358.2; 162/901; 162/903

(58) Field of Classification Search ..... 139/383 A, 139/383 AA; 162/901, 903, 358.2
See application file for complete search history.

(56) References Cited

U.S. PATENT DOCUMENTS 4,501,303 A 2/1985 Osterberg (Continued)

FOREIGN PATENT DOCUMENTS

GB 2351505 1/2001

(Continued)

OTHER PUBLICATIONS

Dale Johnson, Effects of Jet Impingement on Bel Baie Machines, Pulp & Paper Canada 93:5 (1992).

(Continued)

*Primary Examiner*—Bobby H Muromoto, Jr.
(74) *Attorney, Agent, or Firm*—Volpe and Koenig, P.C.

(57) ABSTRACT

Double layer forming fabrics, woven to an overall repeating weave pattern requiring at least 8 sheds in the loom, provide a low drainage area in a notional center plane between the paper and machine side layers, to resist and retard initial impingement drainage. Transverse binder yarn pairs follow a single combined path interweaving with paper side layer and machine side layer yarns, with long internal floats under at least four paper side layer yarns between exchange points and interlacing points in the machine side layer. The members of the pairs are laterally displaced in relation to each other along the single combined path. The fabric has a total warp fill after heatsetting of at least 100%. The drainage areas of the paper side layer and the machine side layers are between 25% and 50%, and the center plane drainage area is between 8% and 20%.

28 Claims, 12 Drawing Sheets

U.S. PATENT DOCUMENTS

| | | | | |
|---|---|---|---|---|
| 4,605,585 | A | 8/1986 | Johansson | |
| 4,776,373 | A | 10/1988 | Borel | |
| 4,815,499 | A | 3/1989 | Johnson | |
| 5,152,326 | A | 10/1992 | Vohringer | |
| 5,164,249 | A | 11/1992 | Tyler et al. | |
| 5,544,678 | A | 8/1996 | Barrett | |
| 5,826,627 | A * | 10/1998 | Seabrook et al. | 139/383 A |
| 5,865,219 | A | 2/1999 | Lee et al. | |
| 6,202,705 | B1 * | 3/2001 | Johnson et al. | 139/383 A |
| 6,223,780 | B1 | 5/2001 | Kaldenhoff | |
| 6,334,467 | B1 * | 1/2002 | Barrett et al. | 139/383 A |
| 6,581,645 | B1 * | 6/2003 | Johnson et al. | 139/383 A |
| 6,810,917 | B2 * | 11/2004 | Stone | 139/383 A |
| 6,904,942 | B2 * | 6/2005 | Odenthal | 139/383 A |
| 7,124,781 | B2 * | 10/2006 | Fahrer et al. | 139/383 A |
| 7,373,957 | B2 * | 5/2008 | Heger et al. | 139/383 A |
| 2003/0217782 | A1 | 11/2003 | Nagura et al. | |
| 2004/0020621 | A1 | 2/2004 | Heger et al. | |
| 2004/0238063 | A1 * | 12/2004 | Stone | 139/383 A |
| 2006/0162804 | A1 * | 7/2006 | Heger et al. | 139/383 A |
| 2006/0169346 | A1 * | 8/2006 | Fahrer et al. | 139/383 A |
| 2006/0211320 | A1 * | 9/2006 | Stone et al. | 442/205 |
| 2006/0249220 | A1 * | 11/2006 | Barrett et al. | 139/383 A |
| 2007/0006934 | A1 | 1/2007 | Quigley et al. | |
| 2007/0006935 | A1 | 1/2007 | Quigley et al. | |
| 2007/0157988 | A1 | 7/2007 | Heger et al. | |
| 2008/0035230 | A1 * | 2/2008 | Danby et al. | 139/383 A |

FOREIGN PATENT DOCUMENTS

| | | |
|---|---|---|
| WO | 9961698 | 12/1999 |
| WO | 0166856 | 9/2001 |
| WO | 2004048684 | 6/2004 |

OTHER PUBLICATIONS

Roger Danby and Jacques Perrault, Weaves of Pepermaking Wires and Forming Fabrics, Montreal, QC 90th Annual PAPTAC Meeting, Jan. 26-28, 2004, p. 2.

* cited by examiner

| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|
| 1 | | | 3 | | | | | 8 | | | 11 | | | | 15 | | | | | 20 | | | 23 | |
| 2 | 1 | | 3 | 4 | 5 | 6 | 7 | 8 | 9 | 10 | 11 | 12 | 13 | | 15 | 16 | 17 | 18 | 19 | 20 | 21 | 22 | 23 | 24 |
| 3 | 1 | | | | 5 | | | | | 10 | | | 13 | | | | 17 | | | | | 22 | | |
| 4 | 1 | 2 | 3 | 4 | 5 | 6 | 7 | 8 | | 10 | 11 | 12 | 13 | 14 | 15 | 16 | 17 | 18 | 19 | 20 | | 22 | 23 | 24 |
| 5 | | | 3 | | | | | 8 | | | | 12 | | | 15 | | | | | 20 | | | | 24 |
| 6 | 1 | | | | 5 | | | | | 10 | | | 13 | | | | 17 | | | | | 22 | | |
| 7 | 1 | 2 | 3 | | 5 | 6 | 7 | 8 | 9 | 10 | 11 | 12 | 13 | 14 | 15 | | 17 | 18 | 19 | 20 | 21 | 22 | 23 | 24 |
| 8 | | | 3 | | | | 7 | | | | | 12 | | | 15 | | | | 19 | | | | | 24 |
| 9 | 1 | 2 | 3 | 4 | 5 | 6 | 7 | 8 | 9 | 10 | | 12 | 13 | 14 | 15 | 16 | 17 | 18 | 19 | 20 | 21 | 22 | | 24 |
| 10 | | 2 | | | 5 | | | | | 10 | | | | 14 | | | 17 | | | | | 22 | | |
| 11 | | | 3 | | | | 7 | | | | | 12 | | | 15 | | | | 19 | | | | | 24 |
| 12 | 1 | 2 | 3 | 4 | 5 | | 7 | 8 | 9 | 10 | 11 | 12 | 13 | 14 | 15 | 16 | 17 | | 19 | 20 | 21 | 22 | 23 | 24 |
| 13 | | 2 | | | 5 | | | | 9 | | | | | 14 | | | 17 | | | | 21 | | | |
| 14 | | 2 | 3 | 4 | 5 | 6 | 7 | 8 | 9 | 10 | 11 | 12 | | 14 | 15 | 16 | 17 | 18 | 19 | 20 | 21 | 22 | 23 | 24 |
| 15 | | | | 4 | | | 7 | | | | | 12 | | | | 16 | | | 19 | | | | | 24 |
| 16 | | 2 | | | 5 | | | | 9 | | | | | 14 | | | 17 | | | | 21 | | | |
| 17 | 1 | 2 | 3 | 4 | 5 | 6 | 7 | | 9 | 10 | 11 | 12 | 13 | 14 | 15 | 16 | 17 | 18 | 19 | | 21 | 22 | 23 | 24 |
| 18 | | | | 4 | | | 7 | | | | 11 | | | | | 16 | | | 19 | | | | 23 | |
| 19 | 1 | 2 | | 4 | 5 | 6 | 7 | 8 | 9 | 10 | 11 | 12 | 13 | 14 | | 16 | 17 | 18 | 19 | 20 | 21 | 22 | 23 | 24 |
| 20 | | 2 | | | | 6 | | | 9 | | | | | 14 | | | | 18 | | | 21 | | | |
| 21 | | | | 4 | | | 7 | | | | 11 | | | | | 16 | | | 19 | | | | 23 | |
| 22 | 1 | 2 | 3 | 4 | 5 | 6 | 7 | 8 | 9 | | 11 | 12 | 13 | 14 | 15 | 16 | 17 | 18 | 19 | 20 | 21 | | 23 | 24 |
| 23 | 1 | | | | | 6 | | | 9 | | | | 13 | | | | | 18 | | | 21 | | | |
| 24 | 1 | 2 | 3 | 4 | | 6 | 7 | 8 | 9 | 10 | 11 | 12 | 13 | 14 | 15 | 16 | | 18 | 19 | 20 | 21 | 22 | 23 | 24 |
| 25 | | | | 4 | | | | 8 | | | 11 | | | | | 16 | | | | 20 | | | 23 | |
| 26 | 1 | | | | | 6 | | | 9 | | | | 13 | | | | | 18 | | | 21 | | | |
| 27 | 1 | 2 | 3 | 4 | 5 | 6 | 7 | 8 | 9 | 10 | 11 | | 13 | 14 | 15 | 16 | 17 | 18 | 19 | 20 | 21 | 22 | 23 | |
| 28 | | | 3 | | | | | 8 | | | 11 | | | | 15 | | | | | 20 | | | 23 | |
| 29 | 1 | 2 | 3 | 4 | 5 | 6 | | 8 | 9 | 10 | 11 | 12 | 13 | 14 | 15 | 16 | 17 | 18 | | 20 | 21 | 22 | 23 | 24 |
| 30 | 1 | | | | | 6 | | | | 10 | | | 13 | | | | | 18 | | | | 22 | | |

FIG. 5

| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|
| 1 | | | 3 | | | | | 8 | | | 11 | | | | 15 | | | | | 20 | | | 23 | |
| 3 | 1 | | | | 5 | | | | | 10 | | | 13 | | | | 17 | | | | | 22 | | |
| 5 | | | 3 | | | | | 8 | | | | 12 | | | 15 | | | | | 20 | | | | 24 |
| 6 | 1 | | | | 5 | | | | | 10 | | | 13 | | | | 17 | | | | | 22 | | |
| 8 | | | 3 | | | | 7 | | | | | 12 | | | 15 | | | | 19 | | | | | 24 |
| 10 | | 2 | | | 5 | | | | | 10 | | | | 14 | | | 17 | | | | | 22 | | |
| 11 | | | 3 | | | | 7 | | | | | 12 | | | 15 | | | | 19 | | | | | 24 |
| 13 | | 2 | | | 5 | | | | 9 | | | | | 14 | | | 17 | | | | 21 | | | |
| 15 | | | | 4 | | | 7 | | | | | 12 | | | | 16 | | | 19 | | | | | 24 |
| 16 | | 2 | | | 5 | | | | 9 | | | | | 14 | | | 17 | | | | 21 | | | |
| 18 | | | | 4 | | | 7 | | | | 11 | | | | | 16 | | | 19 | | | | 23 | |
| 20 | | 2 | | | | 6 | | | 9 | | | | | 14 | | | | 18 | | | 21 | | | |
| 21 | | | | 4 | | | 7 | | | | 11 | | | | | 16 | | | 19 | | | | 23 | |
| 23 | 1 | | | | | 6 | | | 9 | | | | 13 | | | | | 18 | | | 21 | | | |
| 25 | | | | 4 | | | | 8 | | | 11 | | | | | 16 | | | | 20 | | | 23 | |
| 26 | 1 | | | | | 6 | | | 9 | | | | 13 | | | | | 18 | | | 21 | | | |
| 28 | | | 3 | | | | | 8 | | | 11 | | | | 15 | | | | | 20 | | | 23 | |
| 30 | 1 | | | | | 6 | | | | 10 | | | 13 | | | | | 18 | | | | 22 | | |

FIG. 6

| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|
| 1 | 1 | | | | | 6 | | | 9 | | | | 13 | | | | | 18 | | | 21 | | | |
| 2 | 1 | | 3 | 4 | 5 | 6 | 7 | 8 | 9 | 10 | 11 | 12 | 13 | | 15 | 16 | 17 | 18 | 19 | 20 | 21 | 22 | 23 | 24 |
| 3 | | | | 4 | | | | 8 | | | 11 | | | | | 16 | | | | 20 | | | 23 | |
| 4 | 1 | | | | 5 | | | | 9 | | | | 13 | | | | 17 | | | | 21 | | | |
| 5 | 1 | 2 | 3 | 4 | 5 | 6 | 7 | 8 | 9 | | 11 | 12 | 13 | 14 | 15 | 16 | 17 | 18 | 19 | 20 | 21 | | 23 | 24 |
| 6 | | | | 4 | | | | 8 | | | | 12 | | | | 16 | | | | 20 | | | | 24 |
| 7 | 1 | | | | 5 | | | | 9 | | | | 13 | | | | 17 | | | | 21 | | | |
| 8 | 1 | 2 | | 4 | 5 | 6 | 7 | 8 | 9 | 10 | 11 | 12 | 13 | 14 | | 16 | 17 | 18 | 19 | 20 | 21 | 22 | 23 | 24 |
| 9 | | | | 4 | | | | 8 | | | | 12 | | | | 16 | | | | 20 | | | | 24 |
| 10 | | 2 | | | 5 | | | | 9 | | | | | 14 | | | 17 | | | | 21 | | | |
| 11 | 1 | 2 | 3 | 4 | 5 | 6 | 7 | 8 | 9 | 10 | | 12 | 13 | 14 | 15 | 16 | 17 | 18 | 19 | 20 | 21 | 22 | | 24 |
| 12 | | | | 4 | | | 7 | | | | | 12 | | | | 16 | | | 19 | | | | | 24 |
| 13 | | 2 | | | 5 | | | | | 10 | | | | 14 | | | 17 | | | | | 22 | | |
| 14 | 1 | 2 | 3 | 4 | 5 | | 7 | 8 | 9 | 10 | 11 | 12 | 13 | 14 | 15 | 16 | 17 | | 19 | 20 | 21 | 22 | 23 | 24 |
| 15 | | | 3 | | | | 7 | | | | | 12 | | | 15 | | | | 19 | | | | | 24 |
| 16 | | 2 | | | 5 | | | | | 10 | | | | 14 | | | 17 | | | | | 22 | | |
| 17 | | 2 | 3 | 4 | 5 | 6 | 7 | 8 | 9 | 10 | 11 | 12 | | 14 | 15 | 16 | 17 | 18 | 19 | 20 | 21 | 22 | 23 | 24 |
| 18 | | | 3 | | | | 7 | | | | | 12 | | | 15 | | | | 19 | | | | | 24 |
| 19 | | 2 | | | 5 | | | | | 10 | | | | 14 | | | 17 | | | | | 22 | | |
| 20 | 1 | 2 | 3 | 4 | 5 | 6 | 7 | | 9 | 10 | 11 | 12 | 13 | 14 | 15 | 16 | 17 | 18 | 19 | | 21 | 22 | 23 | 24 |
| 21 | | | 3 | | | | 7 | | | | 11 | | | | 15 | | | | 19 | | | | 23 | |
| 22 | | 2 | | | 5 | | | | | 10 | | | | 14 | | | 17 | | | | | 22 | | |
| 23 | 1 | 2 | 3 | | 5 | 6 | 7 | 8 | 9 | 10 | 11 | 12 | 13 | 14 | 15 | | 17 | 18 | 19 | 20 | 21 | 22 | 23 | 24 |
| 24 | | | 3 | | | | 7 | | | | 11 | | | | 15 | | | | 19 | | | | 23 | |
| 25 | | 2 | | | | 6 | | | | 10 | | | | 14 | | | | 18 | | | | 22 | | |
| 26 | 1 | 2 | 3 | 4 | 5 | 6 | 7 | 8 | | 10 | 11 | 12 | 13 | 14 | 15 | 16 | 17 | 18 | 19 | 20 | | 22 | 23 | 24 |
| 27 | | | 3 | | | | 7 | | | | 11 | | | | 15 | | | | 19 | | | | 23 | |
| 28 | 1 | | | | | 6 | | | | 10 | | | 13 | | | | | 18 | | | | 22 | | |
| 29 | 1 | 2 | 3 | 4 | | 6 | 7 | 8 | 9 | 10 | 11 | 12 | 13 | 14 | 15 | 16 | | 18 | 19 | 20 | 21 | 22 | 23 | 24 |
| 30 | | | 3 | | | | | 8 | | | 11 | | | | 15 | | | | | 20 | | | 23 | |
| 31 | 1 | | | | | 6 | | | | 10 | | | 13 | | | | | 18 | | | | 22 | | |
| 32 | 1 | 2 | 3 | 4 | 5 | 6 | 7 | 8 | 9 | 10 | 11 | | 13 | 14 | 15 | 16 | 17 | 18 | 19 | 20 | 21 | 22 | 23 | |
| 33 | | | | 4 | | | | 8 | | | 11 | | | | | 16 | | | | 20 | | | 23 | |
| 34 | 1 | | | | | 6 | | | 9 | | | | 13 | | | | | 18 | | | 21 | | | |
| 35 | 1 | 2 | 3 | 4 | 5 | 6 | | 8 | 9 | 10 | 11 | 12 | 13 | 14 | 15 | 16 | 17 | 18 | | 20 | 21 | 22 | 23 | 24 |
| 36 | | | | 4 | | | | 8 | | | 11 | | | | | 16 | | | | 20 | | | 23 | |

FIG. 7

| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|
| 1 | 1 | | | | 5 | | | | | 10 | | | 13 | | | | 17 | | | | 21 | | | |
| 2 | 1 | | 3 | 4 | 5 | 6 | 7 | 8 | | 10 | 11 | 12 | 13 | 14 | 15 | 16 | 17 | | 19 | 20 | 21 | 22 | 23 | 24 |
| 3 | | | 3 | | | | | 8 | | | | 12 | | | | 16 | | | | 20 | | | | 24 |
| 4 | 1 | | | | 5 | | | | | 10 | | | 13 | | | | 17 | | | | 21 | | | |
| 5 | 1 | 2 | 3 | 4 | 5 | 6 | | 8 | 9 | 10 | 11 | 12 | 13 | 14 | | 16 | 17 | 18 | 19 | 20 | 21 | 22 | | 24 |
| 6 | | | 3 | | | | | 8 | | | | 12 | | | | 16 | | | | 20 | | | | 24 |
| 7 | 1 | | | | | 6 | | | | 10 | | | | 14 | | | 17 | | | | | 22 | | |
| 8 | 1 | 2 | 3 | | 5 | 6 | 7 | 8 | 9 | 10 | | 12 | 13 | 14 | 15 | 16 | 17 | 18 | | 20 | 21 | 22 | 23 | 24 |
| 9 | | | 3 | | | | | 8 | | | | 12 | | | | 16 | | | | 20 | | | | 24 |
| 10 | 1 | | | | | 6 | | | | 10 | | | | 14 | | | 17 | | | | | 22 | | |
| 11 | 1 | | 3 | 4 | 5 | 6 | 7 | 8 | | 10 | 11 | 12 | 13 | 14 | 15 | 16 | 17 | | 19 | 20 | 21 | 22 | 23 | 24 |
| 12 | | | 3 | | | | 7 | | | | | 12 | | | | 16 | | | | 20 | | | | 24 |
| 13 | 1 | | | | | 6 | | | | 10 | | | | 14 | | | 17 | | | | | 22 | | |
| 14 | 1 | 2 | 3 | 4 | | 6 | 7 | 8 | 9 | 10 | 11 | 12 | | 14 | 15 | 16 | 17 | 18 | 19 | 20 | | 22 | 23 | 24 |
| 15 | | | 3 | | | | 7 | | | | | 12 | | | 15 | | | | | 20 | | | 23 | |
| 16 | 1 | | | | | 6 | | | | 10 | | | | 14 | | | 17 | | | | | 22 | | |
| 17 | 1 | 2 | 3 | | 5 | 6 | 7 | 8 | 9 | 10 | | 12 | 13 | 14 | 15 | 16 | 17 | 18 | | 20 | 21 | 22 | 23 | 24 |
| 18 | | | 3 | | | | 7 | | | | | 12 | | | 15 | | | | | 20 | | | 23 | |
| 19 | | 2 | | | | 6 | | | 9 | | | | | 14 | | | | 18 | | | | 22 | | |
| 20 | 1 | 2 | 3 | 4 | 5 | 6 | 7 | | 9 | 10 | 11 | 12 | 13 | 14 | 15 | | 17 | 18 | 19 | 20 | 21 | 22 | 23 | |
| 21 | | | 3 | | | | 7 | | | | | 12 | | | 15 | | | | | 20 | | | 23 | |
| 22 | | 2 | | | | 6 | | | 9 | | | | | 14 | | | | 18 | | | | 22 | | |
| 23 | 1 | 2 | 3 | 4 | | 6 | 7 | 8 | 9 | 10 | 11 | 12 | | 14 | 15 | 16 | 17 | 18 | 19 | 20 | | 22 | 23 | 24 |
| 24 | | | 3 | | | | 7 | | | | | 12 | | | 15 | | | | | 20 | | | 23 | |
| 25 | | 2 | | | | 6 | | | 9 | | | | | 14 | | | | 18 | | | | 22 | | |
| 26 | | 2 | 3 | 4 | 5 | 6 | 7 | 8 | 9 | | 11 | 12 | 13 | 14 | 15 | 16 | | 18 | 19 | 20 | 21 | 22 | 23 | 24 |
| 27 | | | | 4 | | | 7 | | | | 11 | | | | 15 | | | | 19 | | | | 23 | |
| 28 | | 2 | | | | 6 | | | 9 | | | | | 14 | | | | 18 | | | | 22 | | |
| 29 | 1 | 2 | 3 | 4 | 5 | 6 | 7 | | 9 | 10 | 11 | 12 | 13 | 14 | 15 | | 17 | 18 | 19 | 20 | 21 | 22 | 23 | |
| 30 | | | | 4 | | | 7 | | | | 11 | | | | 15 | | | | 19 | | | | 23 | |
| 31 | | 2 | | | 5 | | | | 9 | | | | 13 | | | | | 18 | | | 21 | | | |
| 32 | 1 | 2 | | 4 | 5 | 6 | 7 | 8 | 9 | 10 | 11 | | 13 | 14 | 15 | 16 | 17 | 18 | 19 | | 21 | 22 | 23 | 24 |
| 33 | | | | 4 | | | 7 | | | | 11 | | | | 15 | | | | 19 | | | | 23 | |
| 34 | | 2 | | | 5 | | | | 9 | | | | 13 | | | | | 18 | | | 21 | | | |
| 35 | | 2 | 3 | 4 | 5 | 6 | 7 | 8 | 9 | | 11 | 12 | 13 | 14 | 15 | 16 | | 18 | 19 | 20 | 21 | 22 | 23 | 24 |
| 36 | | | | 4 | | | | 8 | | | 11 | | | | 15 | | | | 19 | | | | 23 | |
| 37 | | 2 | | | 5 | | | | 9 | | | | 13 | | | | | 18 | | | 21 | | | |
| 38 | 1 | 2 | 3 | 4 | 5 | | 7 | 8 | 9 | 10 | 11 | 12 | 13 | | 15 | 16 | 17 | 18 | 19 | 20 | 21 | | 23 | 24 |
| 39 | | | | 4 | | | | 8 | | | 11 | | | | | 16 | | | 19 | | | | | 24 |
| 40 | | 2 | | | 5 | | | | 9 | | | | 13 | | | | | 18 | | | 21 | | | |
| 41 | 1 | 2 | | 4 | 5 | 6 | 7 | 8 | 9 | 10 | 11 | | 13 | 14 | 15 | 16 | 17 | 18 | 19 | | 21 | 22 | 23 | 24 |
| 42 | | | | 4 | | | | 8 | | | 11 | | | | | 16 | | | 19 | | | | | 24 |
| 43 | 1 | | | | 5 | | | | | 10 | | | 13 | | | | 17 | | | | 21 | | | |
| 44 | 1 | 2 | 3 | 4 | 5 | 6 | | 8 | 9 | 10 | 11 | 12 | 13 | 14 | | 16 | 17 | 18 | 19 | 20 | 21 | 22 | | 24 |
| 45 | | | | 4 | | | | 8 | | | 11 | | | | | 16 | | | 19 | | | | | 24 |
| 46 | 1 | | | | 5 | | | | | 10 | | | 13 | | | | 17 | | | | 21 | | | |
| 47 | 1 | 2 | 3 | 4 | 5 | | 7 | 8 | 9 | 10 | 11 | 12 | 13 | | 15 | 16 | 17 | 18 | 19 | 20 | 21 | | 23 | 24 |
| 48 | | | | 4 | | | | 8 | | | 11 | | | | | 16 | | | 19 | | | | | 24 |

FIG. 8

| | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 1 | | 2 | | | 5 | | | | | 10 | | | | 14 | | |
| 2 | | 2 | 3 | 4 | 5 | 6 | 7 | 8 | 9 | 10 | 11 | 12 | 13 | 14 | 15 | |
| 3 | | | 3 | | | | 7 | | | | | 12 | | | 15 | |
| 4 | | 2 | | | 5 | | | | | 10 | | | | 14 | | |
| 5 | 1 | 2 | 3 | 4 | 5 | | 7 | | 9 | 10 | 11 | 12 | 13 | 14 | 15 | 16 |
| 6 | | | | 4 | | | 7 | | | | | 12 | | | 15 | |
| 7 | | 2 | | | 5 | | | | 9 | | | | | 14 | | |
| 8 | 1 | 2 | 3 | 4 | 5 | 6 | 7 | 8 | 9 | 10 | | 12 | | 14 | 15 | 16 |
| 9 | | | | 4 | | | 7 | | | | | 12 | | | 15 | |
| 10 | | 2 | | | 5 | | | | 9 | | | | | 14 | | |
| 11 | | 2 | | 4 | 5 | 6 | 7 | 8 | 9 | 10 | 11 | 12 | 13 | 14 | 15 | 16 |
| 12 | | | | 4 | | | 7 | | | | | 12 | | | | 16 |
| 13 | | 2 | | | 5 | | | | 9 | | | | | 14 | | |
| 14 | 1 | 2 | 3 | 4 | 5 | 6 | 7 | | 9 | | 11 | 12 | 13 | 14 | 15 | 16 |
| 15 | | | | 4 | | | 7 | | | | 11 | | | | | 16 |
| 16 | | 2 | | | | 6 | | | 9 | | | | | 14 | | |
| 17 | 1 | 2 | 3 | 4 | 5 | 6 | 7 | 8 | 9 | 10 | 11 | 12 | | 14 | | 16 |
| 18 | | | | 4 | | | 7 | | | | 11 | | | | | 16 |
| 19 | 1 | | | | | 6 | | | 9 | | | | | 14 | | |
| 20 | 1 | 2 | | 4 | | 6 | 7 | 8 | 9 | 10 | 11 | 12 | 13 | 14 | 15 | 16 |
| 21 | | | | 4 | | | 7 | | | | 11 | | | | | 16 |
| 22 | 1 | | | | | 6 | | | 9 | | | | | 14 | | |
| 23 | 1 | 2 | 3 | 4 | 5 | 6 | 7 | 8 | 9 | | 11 | | 13 | 14 | 15 | 16 |
| 24 | | | | 4 | | | | 8 | | | 11 | | | | | 16 |
| 25 | 1 | | | | | 6 | | | 9 | | | | 13 | | | |
| 26 | 1 | | 3 | 4 | 5 | 6 | 7 | 8 | 9 | 10 | 11 | 12 | 13 | 14 | | 16 |
| 27 | | | | 4 | | | | 8 | | | 11 | | | | | 16 |
| 28 | 1 | | | | | 6 | | | 9 | | | | 13 | | | |
| 29 | 1 | 2 | 3 | 4 | | 6 | | 8 | 9 | 10 | 11 | 12 | 13 | 14 | 15 | 16 |
| 30 | | | 3 | | | | | 8 | | | 11 | | | | | 16 |
| 31 | 1 | | | | | 6 | | | | 10 | | | 13 | | | |
| 32 | 1 | 2 | 3 | 4 | 5 | 6 | 7 | 8 | 9 | 10 | 11 | | 13 | | 15 | 16 |
| 33 | | | 3 | | | | | 8 | | | 11 | | | | | 16 |
| 34 | 1 | | | | | 6 | | | | 10 | | | 13 | | | |
| 35 | 1 | | 3 | | 5 | 6 | 7 | 8 | 9 | 10 | 11 | 12 | 13 | 14 | 15 | 16 |
| 36 | | | 3 | | | | | 8 | | | 11 | | | | 15 | |
| 37 | 1 | | | | | 6 | | | | 10 | | | 13 | | | |
| 38 | 1 | 2 | 3 | 4 | 5 | 6 | | 8 | | 10 | 11 | 12 | 13 | 14 | 15 | 16 |
| 39 | | | 3 | | | | | 8 | | | | 12 | | | 15 | |
| 40 | 1 | | | | 5 | | | | | 10 | | | 13 | | | |
| 41 | 1 | 2 | 3 | 4 | 5 | 6 | 7 | 8 | 9 | 10 | 11 | 12 | 13 | | 15 | |
| 42 | | | 3 | | | | | 8 | | | | 12 | | | 15 | |
| 43 | | 2 | | | 5 | | | | | 10 | | | 13 | | | |
| 44 | 1 | 2 | 3 | | 5 | | 7 | 8 | 9 | 10 | 11 | 12 | 13 | 14 | 15 | 16 |
| 45 | | | 3 | | | | | 8 | | | | 12 | | | 15 | |
| 46 | | 2 | | | 5 | | | | | 10 | | | 13 | | | |
| 47 | 1 | 2 | 3 | 4 | 5 | 6 | 7 | 8 | | 10 | | 12 | 13 | 14 | 15 | 16 |
| 48 | | | 3 | | | | 7 | | | | | 12 | | | 15 | |

FIG. 9

| | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 1 | | 2 | | | | 6 | | | 9 | | | | | 14 | | |
| 2 | | 2 | 3 | 4 | 5 | 6 | 7 | 8 | 9 | 10 | 11 | 12 | 13 | 14 | 15 | |
| 3 | | | 3 | | | | 7 | | | | | 12 | | | 15 | |
| 4 | | 2 | | | | 6 | | | 9 | | | | | 14 | | |
| 5 | 1 | 2 | 3 | 4 | | 6 | 7 | | 9 | 10 | 11 | 12 | 13 | 14 | 15 | 16 |
| 6 | | | | 4 | | | 7 | | | | | 12 | | | 15 | |
| 7 | | 2 | | | | 6 | | | | 10 | | | | 14 | | |
| 8 | 1 | 2 | 3 | 4 | 5 | 6 | 7 | 8 | 9 | 10 | | 12 | | 14 | 15 | 16 |
| 9 | | | | 4 | | | 7 | | | | | 12 | | | 15 | |
| 10 | | 2 | | | | 6 | | | | 10 | | | | 14 | | |
| 11 | | 2 | | 4 | 5 | 6 | 7 | 8 | 9 | 10 | 11 | 12 | 13 | 14 | 15 | 16 |
| 12 | | | | 4 | | | 7 | | | | | 12 | | | | 16 |
| 13 | | 2 | | | | 6 | | | | 10 | | | | 14 | | |
| 14 | 1 | 2 | 3 | 4 | 5 | 6 | 7 | | | 10 | 11 | 12 | 13 | 14 | 15 | 16 |
| 15 | | | | 4 | | | 7 | | | | 11 | | | | | 16 |
| 16 | | 2 | | | 5 | | | | | 10 | | | | 14 | | |
| 17 | 1 | 2 | 3 | 4 | 5 | 6 | 7 | 8 | 9 | 10 | 11 | 12 | | 14 | | 16 |
| 18 | | | | 4 | | | 7 | | | | 11 | | | | | 16 |
| 19 | 1 | | | | 5 | | | | | 10 | | | | 14 | | |
| 20 | 1 | 2 | | 4 | 5 | | 7 | 8 | 9 | 10 | 11 | 12 | 13 | 14 | 15 | 16 |
| 21 | | | | 4 | | | 7 | | | | 11 | | | | | 16 |
| 22 | 1 | | | | 5 | | | | | 10 | | | | 14 | | |
| 23 | 1 | 2 | 3 | 4 | 5 | 6 | 7 | 8 | | 10 | 11 | | 13 | 14 | 15 | 16 |
| 24 | | | | 4 | | | | 8 | | | 11 | | | | | 16 |
| 25 | 1 | | | | 5 | | | | | 10 | | | 13 | | | |
| 26 | 1 | | 3 | 4 | 5 | 6 | 7 | 8 | 9 | 10 | 11 | 12 | 13 | 14 | | 16 |
| 27 | | | | 4 | | | | 8 | | | 11 | | | | | 16 |
| 28 | 1 | | | | 5 | | | | | 10 | | | 13 | | | |
| 29 | 1 | 2 | 3 | 4 | 5 | | | 8 | 9 | 10 | 11 | 12 | 13 | 14 | 15 | 16 |
| 30 | | | 3 | | | | | 8 | | | 11 | | | | | 16 |
| 31 | 1 | | | | 5 | | | | 9 | | | | 13 | | | |
| 32 | 1 | 2 | 3 | 4 | 5 | 6 | 7 | 8 | 9 | 10 | 11 | | 13 | | 15 | 16 |
| 33 | | | 3 | | | | | 8 | | | 11 | | | | | 16 |
| 34 | 1 | | | | 5 | | | | 9 | | | | 13 | | | |
| 35 | 1 | | 3 | | 5 | 6 | 7 | 8 | 9 | 10 | 11 | 12 | 13 | 14 | 15 | 16 |
| 36 | | | 3 | | | | | 8 | | | 11 | | | | 15 | |
| 37 | 1 | | | | 5 | | | | 9 | | | | 13 | | | |
| 38 | 1 | 2 | 3 | 4 | 5 | 6 | | 8 | 9 | | 11 | 12 | 13 | 14 | 15 | 16 |
| 39 | | | 3 | | | | | 8 | | | | 12 | | | 15 | |
| 40 | 1 | | | | | 6 | | | 9 | | | | 13 | | | |
| 41 | 1 | 2 | 3 | 4 | 5 | 6 | 7 | 8 | 9 | 10 | 11 | 12 | 13 | | 15 | |
| 42 | | | 3 | | | | | 8 | | | | 12 | | | 15 | |
| 43 | | 2 | | | | 6 | | | 9 | | | | 13 | | | |
| 44 | 1 | 2 | 3 | | | 6 | 7 | 8 | 9 | 10 | 11 | 12 | 13 | 14 | 15 | 16 |
| 45 | | | 3 | | | | | 8 | | | | 12 | | | 15 | |
| 46 | | 2 | | | | 6 | | | 9 | | | | 13 | | | |
| 47 | 1 | 2 | 3 | 4 | 5 | 6 | 7 | 8 | 9 | | | 12 | 13 | 14 | 15 | 16 |
| 48 | | | 3 | | | | 7 | | | | | 12 | | | 15 | |

FIG. 10

DOUBLE LAYER FORMING FABRIC WITH HIGH CENTER PLANE RESISTANCE

FIELD OF THE INVENTION

The present invention relates to forming fabrics for use in papermaking machines. It is particularly concerned with double layer forming fabrics which are structured to provide a low drainage area in a notional centre plane between the paper and machine side layers so as to resist and retard initial impingement drainage through the fabrics.

BACKGROUND OF THE INVENTION

As used herein, the term "double layer forming fabric" refers to forming fabrics comprising two sets of yarns oriented in a first direction, one set located on the paper side and the other set located on the machine side of the fabric, and which are bound together by a single set of binder yarns oriented in a transverse direction and woven as pairs. The weave patterns of each of the paper and machine side surfaces, as determined by the overall fabric weave pattern, are either substantially the same or different. Further, as used herein, the term "transverse" refers to either the machine direction or the cross machine direction of the fabric.

The binder yarns in the fabrics of this invention can be either weft yarns pairs, similar to those described, for example, by Johnson in U.S. Pat. No. 4,815,499, Barrett in U.S. Pat. No. 5,544,678, or Seabrook et al. in U.S. Pat. No. 5,826,627, or they can be warp yarn pairs such as are described in published US patent applications numbers 2003/0217782 by Nagura et al or US 2004/0020621 by Heger et al., or any of U.S. Pat. Nos. 5,152,326 to Vohringer, 4,605,585 to Johansson, 4,501,303 to Osterberg, and 6,223,780 to Kaldenhoff.

In the double layer forming fabrics of the present invention, all of the yarns oriented in the transverse direction as defined above comprise pairs of binder yarns, and the paper side layer and the machine side layer are each woven to provide different, but related, weave patterns.

As used herein, the following terms have the following meanings:

The term "binder yarn" refers to a yarn which occupies a path in the paper side layer and which separately interlaces with a machine side layer yarn to occupy a path in the machine side layer. Either the warp yarns or the weft yarns in the fabric may be used as binder yarns. All of the yarns oriented in the transverse direction (as described above) in the fabrics of this invention are binder yarns.

The term "drainage area", expressed as a percentage of the area of the fabric weave pattern repeat, refers to the proportion of that area not occupied by the yarns, both warp and weft, used in weaving the fabric at a given substantially planar location within the fabric substantially parallel to the paper side surface and to the machine side surface of the forming fabric.

The term "fibre support index" or "FSI" refers to a calculation made according to the method described by Beran and summarized in Danby, R. & Perrault, J., "Weaves of Papermaking Wires and Forming Fabrics", Montreal, QC, 90$^{th}$ Annual PAPTAC Meeting, Jan. 26-28, 2004, page 2, and which provides a measure of the number of support points which are available to support the papermaking fibres on the paper side surface of a given fabric weave pattern.

The term "float" refers to that portion of a component yarn which passes over a group of other yarns in the fabric without interweaving or interlacing with them; the associated term "float length" refers to the length of a float, expressed as a number indicating the number of yarns passed over. A float length can be expressed in terms of numbers of paper side layer or machine side layer warp or weft yarns.

The term "frame" refers to the substantially rectangular drainage area defined by the longitudinal axis of four interwoven yarns in the paper side surface of the paper side layer of a forming fabric. The number of frames per unit area is identified by the associated terms "frames/in$^2$" or "frames/cm$^2$".

The term "interlace" refers to a locus at which a yarn forms at least one knuckle with another yarn in the machine side layer.

The term "internal float" refers to that portion of a component yarn which passes between two sets of yarns; the associated term "internal float length" in relation to this invention refers to the length of an internal float, expressed as a number indicating the number of PS yarns passed under.

The term "interweave" refers to a locus at which a yarn forms at least one knuckle with another yarn in the paper side layer.

The term "machine direction", or "MD" refers to a line parallel to the direction of travel of the forming fabric when in use on the papermaking machine. The term "cross machine direction" or "CD" refers to a direction substantially perpendicular to the machine direction within the plane of the fabric. In the fabrics of the present invention, either the first direction, or the transverse direction, may be parallel to the MD, depending on the construction of the fabric and whether the binder yarns are warp or weft yarns i.e. if the warp yarns are the binder yarns, the transverse direction is parallel to the MD. The fabrics of the present invention are generally flat woven and seamed so that the warp yarns are oriented in the MD when the fabric is in use.

The term "paper side layer" refers to the layer in the forming fabric onto which the stock is delivered from the head box slice. The term "machine side layer" refers to the layer in the forming fabric in contact with the support means in the papermaking machine. Thus each of these layers has a paper side surface ("PS") and a machine side surface ("MS"). In the double layer fabrics of the invention, the machine side surface of the paper side layer is adjacent to the paper side surface of the machine side layer.

The term "segment" refers to a portion of the single path occupied by a specific binder yarn in one repeat of the overall weave pattern, and the associated term "segment length" refers to the length of a particular segment, and is expressed as the number of paper side layer yarns with which a member of a pair of binder yarns interweaves within the segment.

Forming fabrics are used in papermaking machines to retain and support the papermaking fibres in the stock, to allow water to drain from the stock so that an embryonic fibrous web may form and to convey that web to subsequent areas of the papermaking machine. Initially these fabrics were woven from metal wire, typically phosphor bronze or stainless steel; in recent times yarns created from thermoplastic resins have become the material of choice. Currently preferred resins include polyesters, polyamides and various polymer blends.

The simplest forming fabrics are woven as single layer structures. Although single layer fabrics are known and used, they have several well documented disadvantages when used in certain papermaking conditions.

To overcome these disadvantages, double layer forming fabrics have been developed which consist essentially of two layers: these are a paper side layer which provides the surface on which an incipient paper web is formed, and a machine side layer which provides the surface that is in contact with the static supporting surfaces of the paper making machine. As noted above, within the overall forming fabric weave pattern, either warp yarns or weft yarns can be used as binder yarns which serve to hold the layers of the double layer fabric together and may contribute to the structure of one of the layers. It then follows that although the layers are bound together by the weaving process into a single fabric with a single overall repeating weave pattern, each of the layers is often constructed quite differently in terms of yarn sizes, yarn cross sectional shapes, yarn count (in terms of numbers of yarns per unit length), yarn fill (expressed as a percentage of the amount of yarns and their size relative to the total space available to accommodate them) and the thermoplastic polymer used in the yarns. It then also follows that at least the water handling capabilities, the wear resistance capabilities, and the strength capabilities of each layer, when considered separately, are commonly quite different.

Modern forming fabrics are woven so as to provide a paper side layer which imparts, amongst other things, a minimum of fabric mark to, and provides adequate drainage of liquid from, the incipient paper web. The paper side layer should also provide maximum support for the fibres and other papermaking solids in the paper slurry. The machine side layer should be tough and durable, and provide a measure of dimensional stability to the forming fabric so as to minimize fabric stretching and narrowing, or other distortions.

Weave patterns are known for double layer forming fabrics in which the warp yarns comprise pairs, alternately forming part of the paper side and the machine side weaves. In such patterns, when one member of a pair passes from the paper side layer to the machine side layer, the second member of the pair passes from the machine side layer to the paper side layer, thus completing the weave pattern and while binding the two layers together. Examples of such patterns are found, for example, in published US application Nos. 2003/0217782 of Nagura et al., 2004/0020621 of Heger et al., and in US patents 5,152,326 to Vohringer, 4,605,585 to Johansson, 4,501,303 to Osterberg, and 6,223,780 to Kaldenhoff. Others are known.

Nagura et al. in US 2004/0020621 disclose a double layer fabric in which warp pairs serve as binder yarns to interconnect the paper and machine side layer weft yarns. The yarns are arranged in the overall fabric pattern such that each warp yarn pair member replaces the other to complete the weave pattern of the opposite surface as the yarns exchange locations between the surfaces.

Heger et al. in US 2004/0020621 disclose a double layer forming fabric likewise comprised of pairs of warp yarns which alternately interweave with the PS and exchange positions to interlace with the MS and thus complete the weave pattern repeat of each of these two surfaces. The path taken by the two warp yarns as they enter into and exit from the PS is each different, and two warp of adjacent pairs must pass together under a common MS weft yarn.

Each of Vohringer, in U.S. Pat. No. 5,152,326, Johansson in U.S. Pat. No. 4,605,585 and Osterberg in U.S. Pat. No. 4,501,303 discloses a forming fabric having first and second yarn systems interconnected by a third system comprising pairs of yarns which together form a regular pattern on the paper side surface of the fabric. Kaldenhoff discloses a similar construction but uses both warp and weft binder yarns.

One problem which is common to all papermaking machines and which can have an adverse effect on the formation properties of the web, and has not been significantly addressed by these known weave patterns, is the problem of "impingement drainage" as will be discussed in greater detail below.

In the initial portion of either a single fabric or a twin fabric forming section (either with or without an initial open surface portion), an unsupported jet of highly aqueous stock is ejected at high speed from the head box slice onto the open surface of a moving forming fabric, or into the more or less convergent wedge shaped space between two moving forming fabrics. The jet of aqueous stock will typically traverse a short distance before impinging the surface of the forming fabric, or fabrics, at the point of impingement. The angle of impingement formed between the linear axis of the stock jet and the surface of the forming fabric, or fabrics, on which paper is made is generally quite small, and typically is of the order of from about $4^0$ to about $10^0$. Since the angle of impingement cannot be zero, which is to say tangential to the fabric surface, or fabric surfaces in a twin fabric paper making machine, at least in part because the stock jet widens in the direction perpendicular to the fabric surface or surfaces in the space between the head box slice and the point of impingement, the pressure exerted by the stock jet onto the forming fabric or fabrics can be resolved into two components: a component essentially tangential to the fabric surface, and a component essentially perpendicular to the fabric surface, both of which when combined have a considerable effect on impingement drainage rates. These forces are directly proportional to the speed at which the forming fabric moves in the machine direction: as the machine speed increases so do the impingement forces.

In modern high speed papermaking machines in which the forming fabric(s) can be moving at speeds up to 100 kph, the minor pressure component vertical to the fabric surface exerts a significant level of force on the forming fabric, which can cause excessive impingement derived drainage of the stock over the initial portion of the forming section. This minor pressure component (the "impingement pressure") and the turbulent forces created by stationary drainage elements, combined with the increased use of particulate fillers and shorter papermaking fibres, have the effect of reducing first pass retention and increasing the embedment of the initial layers of the embryonic web into the paper side surface of the forming fabric.

It is well known that, on any papermaking machine under start up conditions and delivering a normal papermaking volume of water but without papermaking fibres from the headbox slice onto the forming fabric, this water will drain within a very short distance, approximately 12 inches (30 cm), or less than 1% of the total available drainage length of the typical forming section. This indicates that, without fibres, all forming fabrics have far in excess of the drainage capacity required to make paper. However, as soon as papermaking fibres are introduced, drainage is retarded at a rate determined by the length of the fibres, the quantity of fibres, the support characteristics of the papermaking surface of the forming fabric, and by the forces resisting and retarding impingement drainage. It was for this reason that the original forming boards installed on open surface fourdrinier type papermaking machines were so successful. In more modern twin wire formers such as gap formers, the impingement shoe serves that function.

It is known (from Johnson, Dale B., "Effect of Jet Impingement in Bel Baie Machines", Pulp and Paper Canada, 9385 (1992)) that impingement drainage can cause sheet marking, low retention by the forming fabric of papermaking fibres, fines and fillers (i.e. low first pass retention), and plugging (i.e. sheet sealing) of the paper side layer of the forming fabric. Unless the structure of the forming fabric is designed to allow it to better manage and control impingement drainage, further increases in machine speed and/or paper making machine efficiency may be limited, or tied directly to improvements in forming shoe or forming board construction.

None of the prior art discloses fabric constructions that are specifically designed to retard the initial impingement drainage by means of long internal warp or weft floats which restrict the drainage area of the centre plane of the fabric. Although improved paper side layer surface uniformity can be obtained by using weave patterns in which warp yarn pairs together interweave with paper side layer weft yarns in sequence in a manner which provides a single unbroken warp path, known weave patterns have not addressed the problem of impingement drainage. Specifically, there has not been any teaching of weave patterns which allow the binder yarns to reside for greater lengths within the fabric as an internal float so as to close up this centre plane. Nor does the prior art address issues relating to fabric stability and wear resistance arising from a fabric construction which is designed to retard the initial impingement drainage. Both of these features are addressed in the present invention in ways which offer unexpected advantages as discussed herein.

It has now been found that the problems of impingement drainage can be significantly reduced, and the respective advantages of the preferred weave patterns for the paper side layer of these fabrics and the preferred weave patterns for the machine side layer can be retained, by the use of weave patterns in which the fabric layers are bound together by pairs of binder yarns, where the members of each pair together form a single path in the paper side surface, and alternately interlace with the yarns of the machine side layer to contribute to but not form a complete repeat of the machine side layer weave pattern; where the patterns further provide for long internal floats of the binder yarns between the paper side layer and the machine side layer, between successive interweaving and interlacing points. Such weave patterns increase the resistance of the central plane of the fabric to the impingement drainage forces and thereby provide numerous unexpected benefits, as will be discussed below.

Preferably the binder yarns are warp yarns, but they may also be weft yarns, depending on other physical attributes required for the weave pattern, based on the intended end use of the fabric.

It has been found that such weave patterns enhance the following fabric features in a manner not previously available in the prior art.

Firstly, the paper side surface of the fabric offers good sheet support with reduced sheet marking, yet provides sufficient drainage area to remove water to the interior of the fabric without entrapping fibres. This reduces fibre plugging or stapling, and so-called "sheet sealing" which makes removal of the embryonic web from the fabric difficult.

Secondly, the retardation of drainage in the area of the long internal floats of the binder yarns promotes good sheet formation and fines retention on the paper side surface of the fabric, with many of the same benefits to the sheet as are provided by the known forming boards and forming shoes.

Thirdly, the open drainage area of the paper side layer allows for easy passage of air through the sheet top surface to the paper side surface of and thereafter through the forming fabric as the fabric and sheet together pass over the suction boxes and similar drainage devices in the forming section. This high air passage over the vacuum zones will result in the sheet leaving the forming zone in a dryer condition, which will translate into greater efficiencies in both the press and drying sections of the paper machine.

SUMMARY OF THE INVENTION

The present invention seeks to provide a double layer forming fabric for use in either a single fabric papermaking machine, or a twin fabric paper making machine, which fabric provides improved resistance to impingement drainage in the initial portion of the forming section.

This invention further seeks to provide a double layer forming fabric in which all levels of the fabric contribute to the control of fluid flow through the fabric. The present invention relies on the use of pairs of yarns, preferably warp yarns, which are arranged so as to form long internal floats between the paper and machine side layers of the fabric, the yarns remaining within a notional centre plane for up to at least 80% of their paths, thereby reducing the drainage area through the centre plane in the fabric parallel to the paper and machine side surfaces.

Although each pair of binder yarns follows a single combined path, the two members of each pair are adjacent and thus necessarily laterally displaced from each other in the paper side surface at the exchange points, where one member of the pair leaves the paper side layer and the other member enters the paper side layer. In the overall repeating weave patterns of the invention, the long internal floats of the binder yarns, and the appropriate selection of the locations at which each member of a pair interlaces with machine side layer yarns, results in the two members of each pair being somewhat laterally displaced from each other along their lengths between the exchange points, which further restricts impingement drainage.

The effect of these features of the arrangement of the yarns is that the drainage areas of both the machine and paper side layers are greater than that found at this notional centre plane. The reduced drainage area at the centre plane resists the flow of fluid through the fabric so as to retard the very high initial impingement drainage that occurs at or near the point of impingement. This allows the initial web to form more gently and uniformly, with higher first pass retention and less sheet sealing and embedment. The overall effect on the sheet is similar to that provided by the known forming boards and forming shoes.

In a first broad embodiment, the invention therefore seeks to provide a double layer forming fabric for a papermaking machine woven to an overall repeating weave pattern requiring at least 8 sheds in the loom and comprising in combination a paper side layer having a first drainage area and a paper side surface, a machine side layer having a second drainage area, and a centre plane within the fabric, defined as a notional plane substantially parallel to and located between the paper side layer and the machine side layer and having a third drainage area, and the fabric has at least (i) paper side layer yarns and machine side layer yarns each oriented in a first direction; and (ii) a set of yarns comprising only pairs of binder yarns interwoven with the paper side layer yarns and machine side layer yarns in a direction transverse to the first direction, wherein:

(a) in the paper side surface, each pair of binder yarns occupies a single combined path;

(b) the pairs of binder yarns are woven in the overall repeating weave pattern such that for each pair:

(A) in a first segment of the single combined path, a first member of the pair interweaves with selected paper side layer yarns at an interweaving location, and a second member of the pair interlaces with at least one machine side layer yarn at an interlacing location;

(B) in a second segment of the single combined path, the second member of the pair interweaves with selected paper side layer yarns at an interweaving location, and the first member of the pair interlaces with at least one machine side layer yarn;

(C) the length of the first and second segments may be equal or unequal;

(D) between each adjacent segment the members exchange positions at an exchange point, and the members are laterally displaced in relation to each other along the single combined path at and between each consecutive exchange point; and (E) for each member of each pair of binder yarns, between each interweaving location and an immediately subsequent interlacing location, and between each interlacing location and an immediately subsequent interweaving location, the member floats between the paper side layer yarns and the machine-side layer yarns under at least four paper side layer yarns;

(c) in the machine side layer, for each pair of binder yarns, the first member and the second member alternately interlace with selected machine side layer yarns in each repeat of the second repeating weave pattern but do not form a complete repeat of the second repeating weave pattern;

(d) the fabric has a total warp fill after heatsetting of at least 100%

(e) the first drainage area is between 25% and 50%;

(f) the second drainage area is between 25% and 50%; and (g) the third drainage area is between 8% and 20%.

In a second broad embodiment, the invention further seeks to provide a double layer forming fabric for a papermaking machine woven to an overall repeating weave pattern requiring at least 8 sheds in the loom and comprising in combination a paper side layer having a paper side surface, and a machine side layer, the fabric having at least (i) paper side layer yarns and machine side layer yarns each oriented in a first direction; and (ii) a set of yarns comprising only pairs of binder yarns interwoven with the paper side layer yarns and machine side layer yarns in a direction transverse to the first direction, wherein:

(a) in the paper side surface, each pair of binder yarns occupies a single combined path;

(b) the pairs of binder yarns are woven in the overall repeating weave pattern such that for each pair:

(A) in a first segment of the single combined path, a first member of the pair interweaves with selected paper side layer yarns at an interweaving location, and a second member of the pair interlaces with at least one machine side layer yarn at an interlacing location;

(B) in a second segment of the single combined path, the second member of the pair interweaves with selected paper side layer yarns at an interweaving location, and the first member of the pair interlaces with at least one machine side layer yarn;

(C) the length of the first and second segments may be equal or unequal;

(D) between each adjacent segment the members exchange positions at an exchange point, and the members are laterally displaced in relation to each other along the single combined path at and between each consecutive exchange point; and (E) for each member of each pair of binder yarns, between each interweaving location and an immediately subsequent interlacing location, and between each interlacing location and an immediately subsequent interweaving location, the member floats between the paper side layer yarns and the machine side layer yarns under at least four paper side layer yarns;

(c) in the machine side layer, for each pair of binder yarns, the first member and the second member alternately interlace with selected machine side layer yarns in each repeat of the second repeating weave pattern but do not form a complete repeat of the second repeating weave pattern;

(d) the fabric has a total warp fill after heatsetting of at least 100%.

In a third broad embodiment, the invention further seeks to provide a double layer forming fabric for a papermaking machine woven to an overall repeating weave pattern requiring at least 8 sheds in the loom and having a machine direction and a cross-machine direction and comprising in combination a paper side layer having a first drainage area, a machine side layer having a second drainage area, and a centre plane within the fabric, defined as a notional plane substantially parallel to and located between the paper side layer and the machine side layer and having a third drainage area wherein (a) in one of the machine direction and the cross-machine direction, the fabric has a total fill after heatsetting of at least 100%;

(b) the first drainage area is between 25% and 50%;

(c) the second drainage area is between 25% and 50%; and (d) the third drainage area is between 8% and 20%.

Preferably, the binder yarns occupy at least 80% of the centre plane in each repeat of the overall repeating weave pattern, and preferably the third drainage area is between 8% and 15%.

Preferably, the paper side layer yarns do not form stacked pairs over the machine side layer yarns, but are offstacked so that in a cross-section of the fabric in the transverse direction, each paper side layer yarn is laterally displaced from proximate machine side layer yarns.

Preferably, in each repeat of the repeating weave pattern a ratio of the number of paper side layer yarns and the number of machine side layer yarns is selected from 3:1, 3:2, 2:1 and 1:1, but more preferably the ratio is 3:2.

In the fabrics of the invention, the binder yarns may comprise either warp yarns or weft yarns.

Preferably, the machine side layer is woven to a pattern selected from a 6-shed satin, a 12-shed satin, a twill and an N×2N pattern, in which N is the number of sheds in the loom; and more preferably, the machine side layer is woven to an N×2 N pattern.

Preferably, the paper side layer is woven to a pattern selected from a plain weave, a 3-shed twill, a 3-shed satin, a 4-shed twill and a 4-shed satin.

A wide range of overall repeating weave patterns is suitable for the fabrics of the invention, but preferably the overall repeating weave pattern requires 24 sheds.

Preferably, all the yarns for the fabrics of the invention are constructed of monofilament materials. Preferably, the binder yarns are constructed of a monofilament material selected from polyethylene naphthalate and polyethylene terephthalate, and most preferably of polyethylene naphthalate. Preferably, the machine side layer yarns are constructed of a monofilament material selected from nylon, polyethylene terephthalate and a blend of polyethylene terephthalate and polyurethane, such as described in U.S. Pat. Nos. 5,169,711 and 5,502,120.

BRIEF DESCRIPTION OF THE DRAWINGS

The invention will now be described in more detail with reference to the attached drawings in which:

FIG. 5 is a weave diagram of the embodiment of FIG. 1;

FIG. 6 is a weave diagram of the paper side layer of the embodiment of FIG. 1;

FIGS. 7 and 8 are weave diagrams of the embodiments of FIGS. 2 and 3 respectively;

FIG. 9 is a weave diagram of a fabric in a fourth embodiment of the invention;

FIG. 10 is a weave diagram of a fabric in a fifth embodiment of the invention;

DETAILED DESCRIPTION

Figure 1:
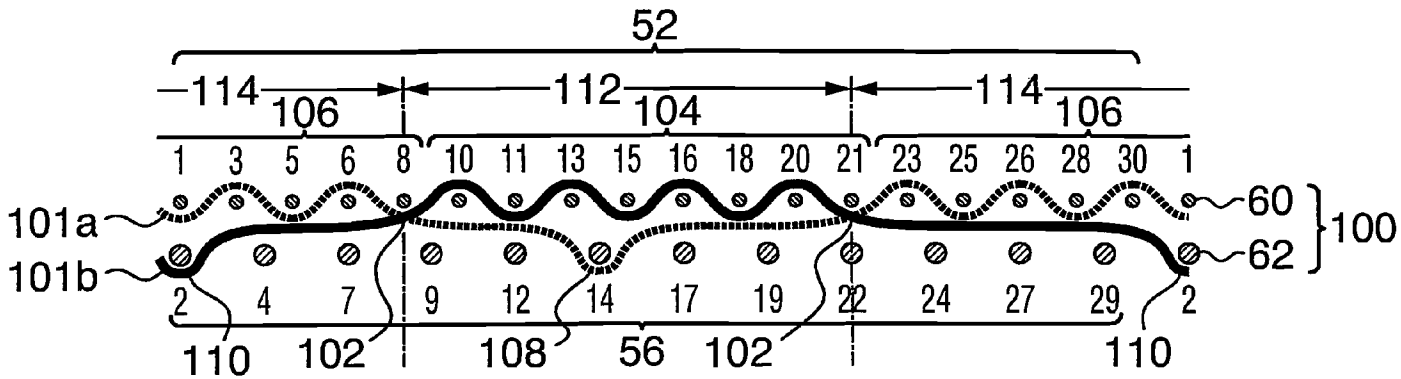
FIG. 1 shows the paths of a pair of warp yarns in one repeat of the weave pattern of a first embodiment of the invention.
Figure 4:
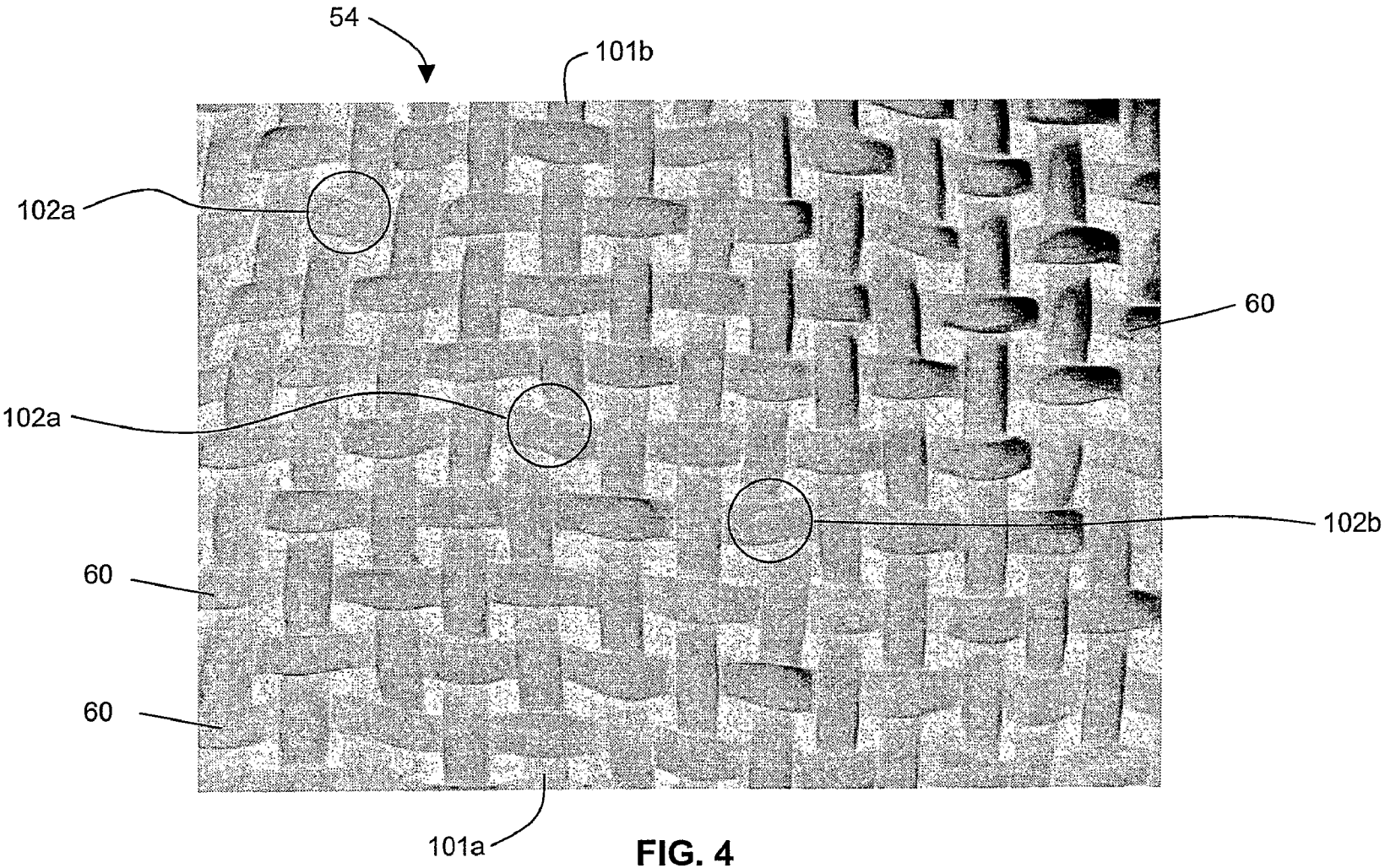
FIG. 4 is a photograph of the paper side surface of the embodiment of FIG. 1.

Referring to FIGS. 1, 4 and 10, a first embodiment of the invention is shown. The fabric 100 has a paper side layer 52, having a paper side surface 54, on which the incipient paper web (not shown) is carried, and is woven to a plain weave pattern with paper side layer weft yarns 60 and pairs of warp yarns 101*a* and 101*b*. The machine side layer 56 is woven to a different pattern, comprising an N×2N weave, in which N quantifies the warp yarns 101*a*, 101*b*, and 2N quantifies the weft yarns 62 in one repeat of the machine side layer weave pattern. In the fabrics of the invention, N is an integer greater than 3. This N×2N pattern is described and claimed in U.S. Pat. No. 5,544,678.

In FIG. 1, the paper side layer weft yarns 60 and the machine side layer weft yarns 62 are individually identified by the appropriate numerals in sequence from 1 to 30.

FIGS. 1 and 10 show the path of a pair of typical warp yarns 101*a* and 101*b* in one repeat of the fabric weave pattern. It can be seen that in a first segment 112, commencing at exchange point 102 under paper side layer weft yarn 8, warp yarn 101*b* interweaves with eight paper side layer weft yarns 10, 11, 13, 15, 16, 18, 20 and 21, at interweave location 104, while warp yarn 101*a* passes between the paper side layer 52 and the machine side layer 56, under paper side layer weft yarns 8, 10, 11 and 13, interlaces with machine side layer weft yarn 14 at interlace location 108, and passes between the paper side layer 52 and the machine side layer 56, under paper side layer weft yarns 15, 16, 18, 20 and 21, meeting warp yarn 101*b* at exchange point 102 under paper side layer weft yarn 21.

In a second segment 114, after exchange point 102*b*, warp yarn 101*a* interweaves with ten paper side layer weft yarns 23, 25, 26, 28, 30, 1, 3, 5, 6 and 8 at interweave location 106, while warp yarn 101*b* passes between the paper side layer 52 and the machine side layer 56, under paper side layer weft yarns 21, 23, 25, 26, 28 and 30, interlaces with machine side layer weft yarn 2 at interlace location 110, and then passes between the paper side layer 52 and the machine side layer 56, under paper side layer weft yarns 3, 5, 6 and 8, meeting warp yarn 101*a* at a subsequent exchange point 102 under paper side layer weft yarn 8.

It can thus be seen that between each interlacing location 104, 106 and the immediately preceding and immediately subsequent exchange points 102, each of warp yarns 101*a*, 101*b* has long internal floats with a float length of at least 4, i.e. passing under at least four paper side layer weft yarns 60.

FIG. 1 also shows that the number of paper side layer weft yarns 60 with which warp yarn 101*a* interweaves at each interweave location 104 (i.e. eight paper side layer weft yarns 60) is not the same as the number of paper side layer weft yarns 60 with which warp yarn 101*b* interweaves at each interweave location 106 (i.e. ten paper side layer weft yarns 60). The weave pattern is thus asymmetrical.

FIG. 4 is a photograph of the paper side surface 54 of a fabric of the invention. All of the yarns shown vertically in the figure are pairs of binder yarns 101*a*, 101*b*, in the transverse direction to the paper side layer yarns 60. As described in relation to FIG. 1, the members of each of these pairs of binder yarns exchange positions at exchange points 102. In FIG. 4, examples of such exchange points are shown as 102*a*, where a binder yarn 101*a* leaves the paper side layer 52 and its pair, binder yarn 101*b*, enters the paper side layer 52; and 102*b*, where a binder yarn 101*b* leaves the paper side layer 52 and its pair, binder yarn 101*a*, enters the paper side layer 52. At these exchange points, 102*a* and 102*b*, the lateral displacement of the members of the binder yarn pairs in relation to each other can be clearly seen. Further, as the binder yarns continue their single combined path following an exchange point 102*a* or 102*b*, the lateral displacement is also continued, so that the member leaving the paper side layer is not entirely under the member which commences interweaving with the paper side layer yarns 60, and thus contributes to the restriction on impingement drainage.

The weave pattern of the embodiment shown in FIG. 1 is described in FIGS. 5 and 6. FIG. 6 shows the weave pattern of only the paper side layer 52 of the fabric 100. The numerals on the left side of the weave diagram correspond to the paper side layer weft yarns 60, with the numbers allocated in FIG. 1. The numerals across the top of the weave diagram are of twelve consecutive pairs of warp yarns 101*a*, 101*b*. Thus the paths of each of the warp yarns identified in FIG. 6 corresponds to the paths of the illustrative warp yarns 101*a*, 101*b* in FIG. 1. From these two figures, and the photograph of the woven fabric in FIG. 4, it can be seen that each pair of warp yarns 101*a*, 101*b* together forms a single combined warp path in the paper side surface 54 of the paper side layer 52. It can also be seen that both warp yarns 101*a* and 101*b* are required to complete the MS weave pattern; thus neither member of a warp yarn pair alone can form a complete repeat of the MS weave pattern. However, as discussed above in relation to FIG. 4, the members of each pair are somewhat laterally displaced at and between the exchange points 102.

FIG. 5 is a weave diagram of the complete fabric, i.e. the combined patterns of the paper side layer 52 and the machine side layer 56, the numerals at the left of the drawing representing the thirty yarns comprising paper side layer weft yarns 60 and machine side layer weft yarns 62, and the numerals across the top of the diagram representing the twenty-four warp yarns of this pattern, comprising twelve consecutive pairs of warp yarns 101*a*, 101*b*.

Figure 2:
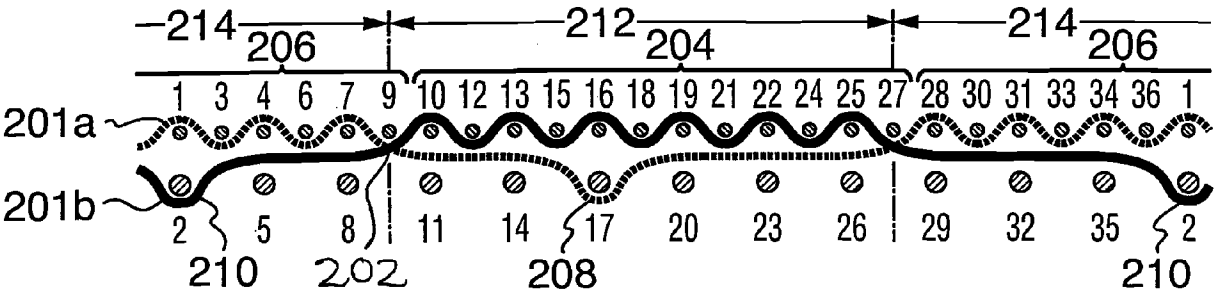
FIG. 2 shows the paths of a pair of warp yarns in one repeat of the weave pattern of a second embodiment of the invention.

Referring now to FIG. 2, the paths of a pair of typical warp yarns 201*a*, 201*b* of a second embodiment are shown, in one repeat of the weave pattern. In FIG. 2, the paper side layer weft yarns 60 and the machine side layer weft yarns 62 are individually identified by the appropriate numerals in sequence from 1 to 36.

As in the embodiment of FIG. 1, the two warp yarns 201*a*, 201*b* together form a single combined warp path in the paper side surface 54 (see FIG. 4) of the paper side layer 52, while being somewhat laterally displaced at and between the exchange points 202. Similarly, the warp yarns 201*a*, 201*b* have long internal floats with a float length of at least 4 between each interlace location 208, 210 and the immediately preceding and immediately subsequent exchange point 202. In this weave pattern, in a first segment 212, warp yarn 201*b* interweaves at interweave location 204 with twelve paper side layer weft yarns 10, 12, 13, 15, 16, 18, 19, 21, 22, 24, 25 and 27, and in a second segment warp yarn 201*a* interweaves at interweave location 206 with twelve paper side layer weft yarns 28, 30, 31, 33, 34, 36, 1, 3, 4, 6, 7 and 9. It should be noted that although the path of warp yarn 201*a* in the paper side layer is identical to the path of warp yarn 201*b* in that layer, the paths of warp yarns 201*a* and 201*b* are not identical in the machine side layer 56, and neither of warp yarns 201*a* and 201*b* forms a complete repeat of the MS layer weave pattern.

Referring to FIG. 7, a weave diagram of the complete weave pattern of the fabric of the second embodiment of the invention is provided. As in the weave diagram of FIG. 6, the numerals at the left side of the drawing represent the thirty-six yarns comprising paper side layer weft yarns 60 and machine side layer weft yarns 62, corresponding to those shown in FIG. 2. The numerals across the top of the drawing represent the twenty-four warp yarns of the pattern, comprising twelve consecutive pairs of warp yarns 201*a*, 201*b*.

Figure 3:
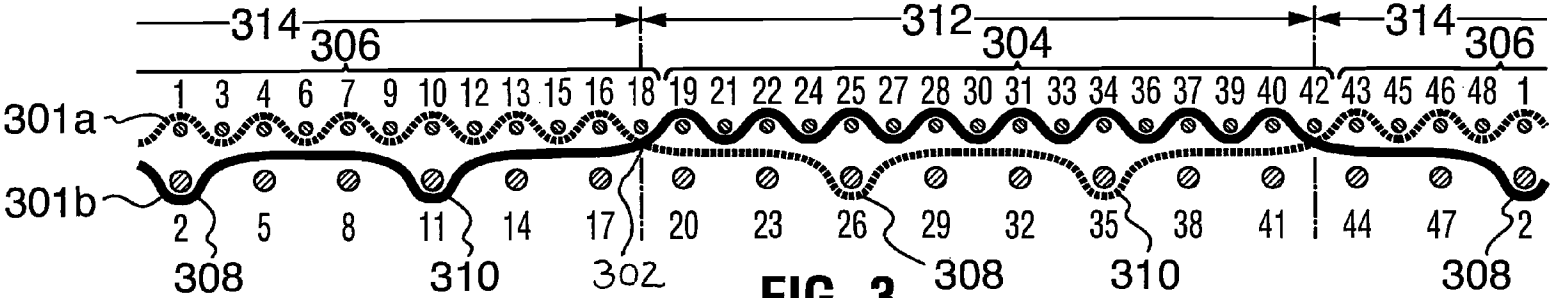
FIG. 3 shows the paths of a pair of warp yarns in one repeat of the weave pattern of a third embodiment of the invention.

Referring now to FIG. 3, the paths of a pair of warp yarns 301*a*, 301*b* of a third embodiment are shown, in one repeat of the weave pattern. In FIG. 3, the paper side layer weft yarns 60 and the machine side layer weft yarns 62 are individually identified by the appropriate numerals in sequence from 1 to 48.

As in the embodiments of FIGS. 1 and 2, the two warp yarns 301*a*, 301*b* together form a single combined warp path in the paper side surface 54 (see FIG. 4) of the paper side layer 52, while being somewhat laterally displaced at and between the exchange points 302. Similarly, the warp yarns 301*a*, 301*b* have long internal floats with a float length of at least 4 between each first interlace location 308 and the immediately preceding exchange point 302; and similarly between each second interlace location 310 and each subsequent exchange point 302. Further, between the two interlace locations 308, 310 for each of warp yarns 301*a*, 301*b*, there is a further long internal float with a float length of at least 4 between the paper side layer 52 and the machine side layer 56. In this weave pattern, in a first segment 312, warp yarn 301*b* interweaves at interweave location 304 with sixteen paper side layer weft yarns 19, 21, 22, 24, 25, 27, 28, 30, 31, 33, 34, 36, 37, 39, 40 and 42; and in a second segment warp yarn 301*a* interweaves at interweave location 306 with sixteen paper side layer weft yarns 43, 45, 46, 48, 1, 3, 4, 6, 7, 9, 10, 12, 13, 15, 16 and 18.

It is apparent that the paths of the two warp yarns 301*a*, 301*b* of each pair follow an identical sequence in the paper side layer 52 and the machine side layer 56.

Referring to FIG. 8, a weave diagram of the complete weave pattern of the fabric of the third embodiment of the invention is provided. As in the weave diagrams of FIGS. 5 and 6, the numerals at the left of the drawing represent the forty-eight yarns comprising paper side layer weft yarns 60 and machine side layer weft yarns 62, corresponding to those shown in FIG. 3. The numerals across the top of the drawing represent the twenty-four warp yarns of the pattern, comprising twelve consecutive pairs of warp yarns 301*a*, 301*b*.

It is possible to weave the fabrics of this invention in a broad number of shed patterns, other than the 24 shed patterns discussed above, while remaining within the scope of the invention. In the fabrics of this invention, each warp yarn floats under at least four paper side layer weft yarns between each interweaving location and an immediately following interlacing location of that warp yarn with a machine side weft yarn; further, neither the first nor second warp yarns of a pair alone forms a complete repeat of the second (machine side layer) repeating weave pattern. However, these two warp yarns together do form a complete repeat. In addition, due to the disclosed warp yarn arrangement in the fabrics of this invention, in the preferred embodiment two warp yarns will always pass either together, or with from 1 to 2 intervening warp yarns, beneath each machine side layer weft yarn so as to form a "double warp knuckle" beneath the weft yarns. Alternatively, the warp yarns may be arranged by means of the chosen weave pattern so that the warp yarns form only single knuckles beneath the weft yarns. As a further alternative, the weave pattern can provide for both single and double knuckles in the machine side surface.

These double warp knuckles offer several advantages not previously available in fabrics woven using warp yarn pairs. First, the two warp yarns act together to more effectively crimp the larger diameter machine side layer weft yarns, causing them to bow outwardly from the fabric surface so as to provide a wear plane on the machine side of the fabric which protects the warp yarns from abrasion, thereby increasing the service life of the fabric. Second, the double warp knuckles allow for the use of relatively larger diameter weft yarns on the machine side surface of the fabric than would otherwise be available in fabric weave designs where only single warp knuckles are created in the weave pattern. Third, the use of these larger diameter machine side layer weft yarns enhances both cross machine direction fabric stability and fabric stiffness, both properties which contribute significantly to overall fabric "runnability" (i.e., to resist creasing and similar fabric distortions when in use). We have found that these features, together with the other features of the invention as described herein, can be provided in a number of different overall fabric weave designs requiring, for example, 12 sheds in the loom, or 16, 18, 20 sheds and more.

The selection of suitable weave patterns for the fabrics of this invention from the broad number of available shed patterns will depend on the end use requirements and the physical restrictions of the loom on which they are woven. FIGS. 8 and 9 provide examples of fabrics woven in accordance with the present invention which are arranged according to 16-shed patterns and which offer the features described above.

Referring now to FIG. 9, a weave diagram of the complete weave pattern of a fourth embodiment of the fabric of the invention is provided, which is similar in aspects to that shown in FIGS. 8 and 3. As in the weave diagram of FIG. 8, the numerals at the left side of the drawing represent the 48 weft yarns comprising the 32 paper side layer weft yarns 60 and the 16 machine side layer weft yarns 62 of this fabric (also as shown in cross-section in FIG. 3). However, whereas the fabric illustrated in FIG. 8 is woven according to a 24-shed pattern, requiring 24 warp yarns and 48 weft yarns in the full repeat, the fabric of FIG. 9 is woven according to a 16-shed pattern requiring 16 warp and 48 weft to construct. The yarn paths of the warp pairs in the fabric of FIG. 9 are similar to those illustrated for typical warp yarns 301*a*, 301*b* in FIG. 3. However, the 16-shed pattern provides some benefits not available in the 24-shed construction. Most notably, it is possible in this 16-shed design to provide a long machine side layer weft yarn float which will take much of the abrasive wear to which the machine side surface is exposed. For example, inspection of FIG. 9 shows that each of the machine side weft yarns 2, 5, 8, 11, 14, 17 . . . form a long machine side float of at least 12 warp yarns (see e.g. weft 5). For example, weft yarn 2 is interlaced only at the opposite ends of the repeat, i.e. with warp yarns 1 and 16. This causes the weft to bow outwardly from the fabric and provide a great deal of material for abrasive wear during use. Further, at certain locations on the machine side of the fabric, two adjacent warp yarns pass together beneath a single weft (e.g. at weft 2, both warps 1 and 16 pass together beneath it). This tends to enhance the weft yarn crimp and recesses the warp yarns from abrasive wear at these locations. However, at most other locations, the interlacing warps are separated from one another by one warp (e.g. at weft 11, the warps 1 and 3 are separated by warp 2. This tends to increase the overall stability of the machine side weave and thus the stability of the fabric.

FIG. 10 is a weave diagram of a fifth embodiment of the invention, which is a fabric very similar to that shown in FIG. 9. The main difference between these two fabrics is that the position of warp yarns 5 and 6, and 9 and 10 in the weave pattern have been exchanged.

The warp paths of the fabrics whose weave diagrams are shown in FIGS. 9 and 10 are substantially as shown in FIG. 3. Inspection of these weave diagrams in association with the warp profiles shows that between each interlacing location (at machine side layer weft yarns 2, 11, 26 and 35) and the immediately preceding and immediately subsequent exchange points, each of the warp yarns has long internal floats between the paper side layer weft yarns 60 and machine side layer weft yarns 62 with a float length of at least 4, i.e. passing under at least four paper side layer weft yarns 60.

FIG. 9 also shows that the number of paper side layer weft yarns 60 with which each first warp yarn of a pair interweaves at each interweave location corresponding with interweave location 314 in FIG. 3 (16 paper side layer weft yarns) is the same as the number of paper side layer weft yarns 60 with which each second warp yarn pair member interweaves at each interweave location corresponding with interweave location 312 in FIG. 3 (16 weft). The weave pattern is thus symmetrical, as shown in FIG. 3, and is different from that shown for example in FIG. 1.

It should further be noted that although each of the warp yarns 101*a*, 101*b*, 201*a*, 201*b*, 301*a* and 301*b* contributes to the respective repeat weave pattern of the machine side layer 56, no pair forms a complete repeat of such pattern.

Figure 11:
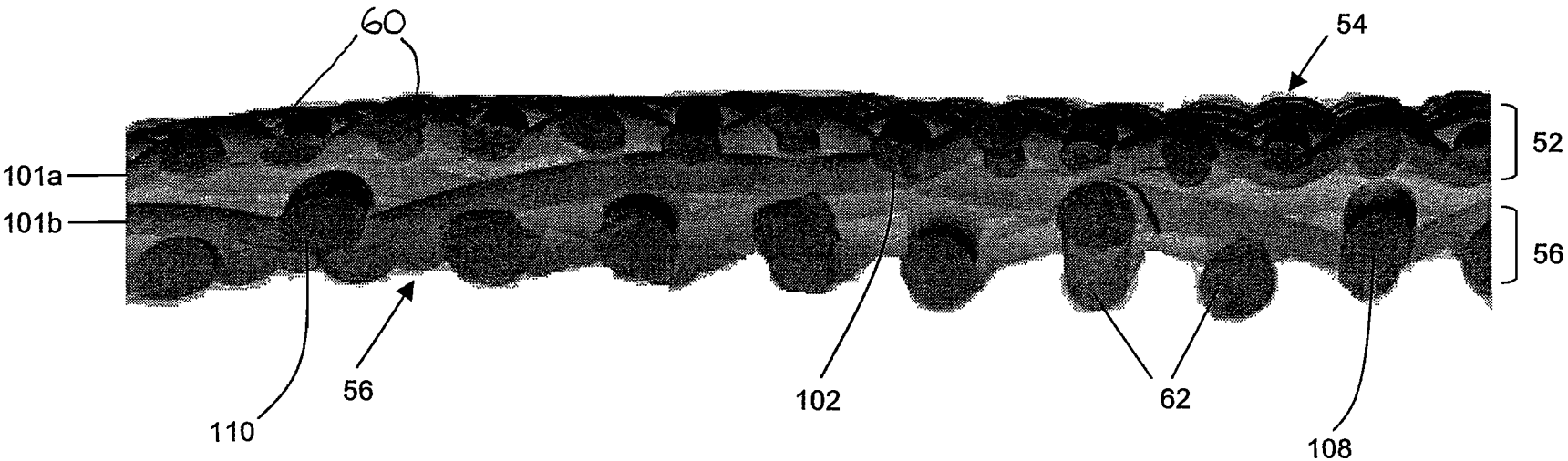
FIG. 11 is a photograph of a cross-section of an embodiment of the invention.

Referring now to FIG. 11, a photograph shows a cross-section in the MD of an embodiment of the invention. The paper side surface 54 of the paper side layer 52 is woven to a plain weave pattern, in which (seen from the left of the figure) warp yarn 101*a* interweaves with selected paper side layer yarns 60 before exchanging positions with warp yarn 101*b* at exchange point 102, remaining between the paper side layer 52 and the machine side layer 56 before interlacing with a selected machine side layer weft 62 at interlacing point 108. Similarly, warp yarn 101*b* interlaces with a selected machine side layer weft 62 at interlacing point 110, remains between the paper side layer 52 and the machine side layer 56, exchanges position with warp yarn 101*a* at exchange point 102, and then interweaves with selected paper side layer weft yarns 60. From this micrograph, the long internal warp floats of the warp yarns 101*a*, 101*b*, which provide the desired restriction on impingement drainage, can clearly be seen.

Referring now to FIGS. 12 to 15, the effect of the weave patterns of the invention can be seen. These four computer-generated figures depict what would be seen at notional planes at selected points within a fabric of the invention, as follows.

Figure 12:
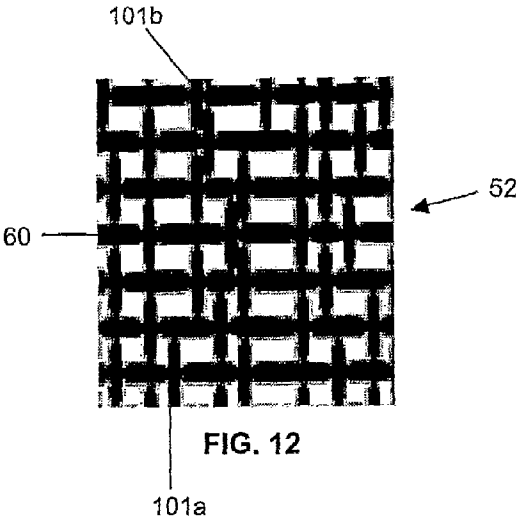

FIG. 12 shows diagrammatically a top plane through the paper side layer 52 of the fabric 100 and substantially parallel to the paper side surface 54, and shows the drainage area of the paper side layer 52 as provided by the binder yarns 101*a*, 101*b*, as they interweave with the paper side layer yarns 60. In this diagram, this first drainage area is approximately 32%.

Figure 13:
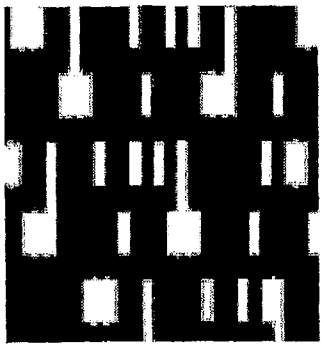

FIG. 13 shows diagrammatically the centre plane in the fabric, being a notional plane between, and substantially parallel to, the paper side layer 52 and the machine side layer 56. This diagram shows the effect of the yarns occupying the space between the paper side layer 52 and the machine side layer 56 on the available drainage area. Careful inspection of this diagram shows that this third drainage area is approximately 16%.

Figure 14:
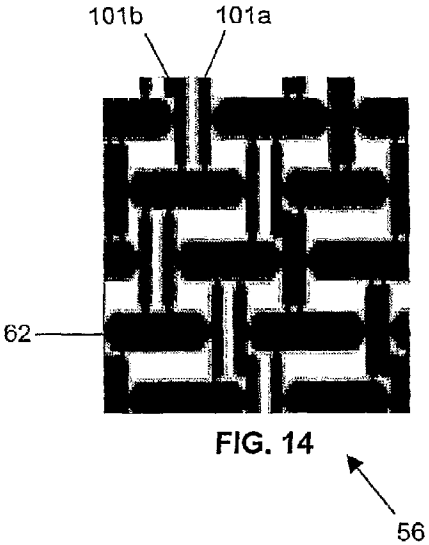
FIGS. 12 to 15 are computer generated cross-sectional diagrams of a fabric of the invention.

FIG. 14 shows diagrammatically the bottom plane in the fabric, showing the drainage area of the machine side layer 56 as provided by the binder yarns 101*a*, 101*b*, as they interlace with the machine side layer yarns 62. In this diagram, this second drainage area is approximately 28%.

Figure 20:
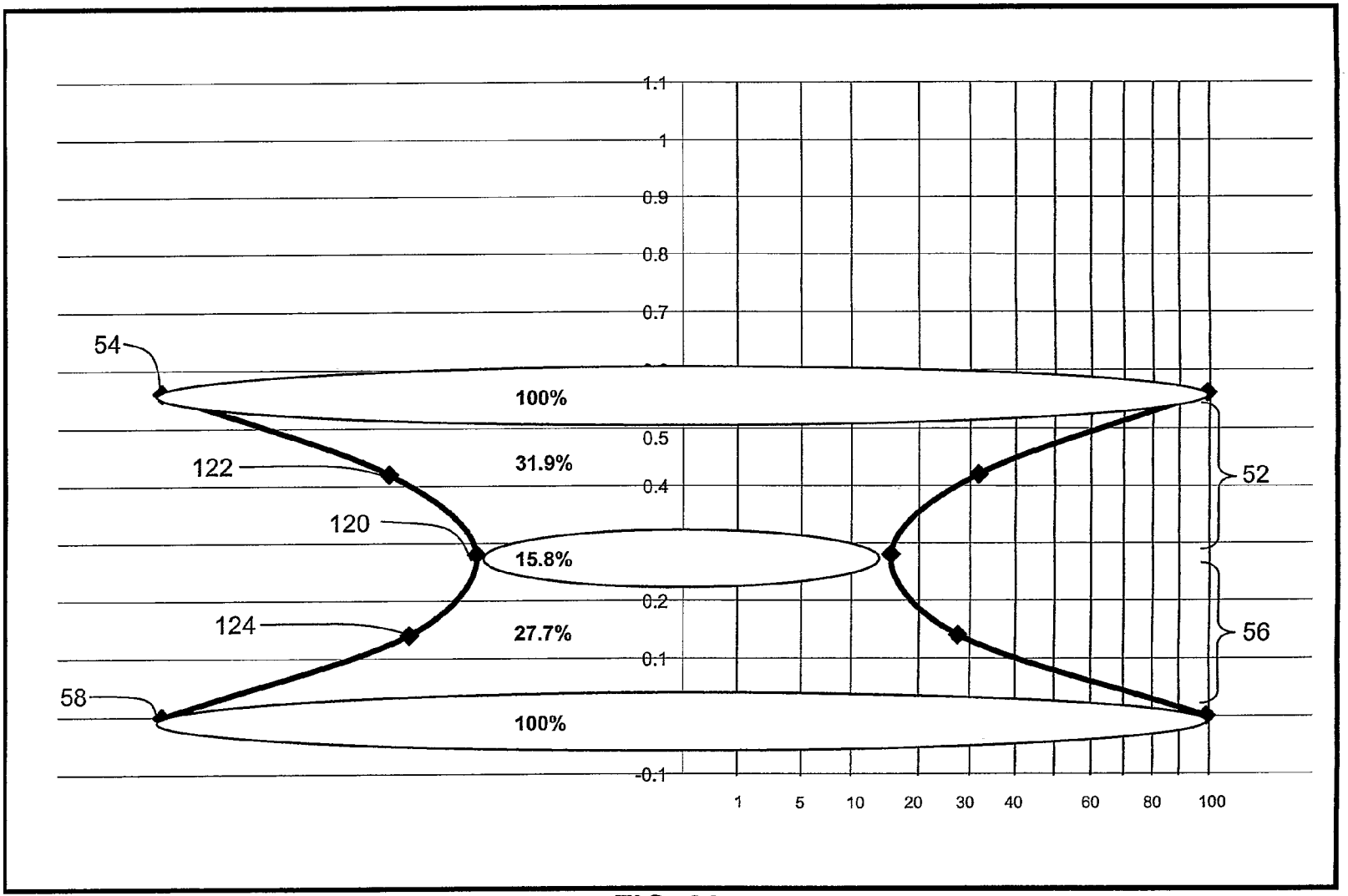
FIG. 20 is a graphical representation of the drainage areas of the fabrics of the invention.

The drainage areas of each of these layers is shown graphically in FIG. 20, which indicates the open area of a fabric of the invention at several points in relation to the depth into the fabric. It can be seen that at each of the paper side surface 54 and the machine side surface 58, the drainage area is 100%. However, within the paper side layer 52, the first drainage area 122 can be seen to be approximately 31.9%, and within the machine side layer 56, the second drainage area 124 is approximately 27.7%. However, at the centre plane between the paper side layer 52 and the machine side layer 56, the third drainage area 120 can be seen to be approximately 15.8%.

Once the white water from the stock has passed through the centre plane of a composite forming fabric, its rate of drainage has little impact on the paper quality unless it becomes too low, for example if the machine side layer of the composite forming fabric becomes plugged. The main purpose of the machine side layer is to provide adequate support for the paper side layer, to provide adequate wear characteristics and to accommodate the stresses imposed on the forming fabric in use.

In the fabrics of the invention, it is the drainage capability of the fabric 100 in the paper side layer 52 and at the centre plane between the paper side layer 52 and the machine side layer 56 combined which will determine the ability of the fabric to resist impingement drainage. This capability of the fabric 100 can be assessed diagrammatically by combining FIGS. 12 and 13 to provide FIG. 15.

Figure 15:
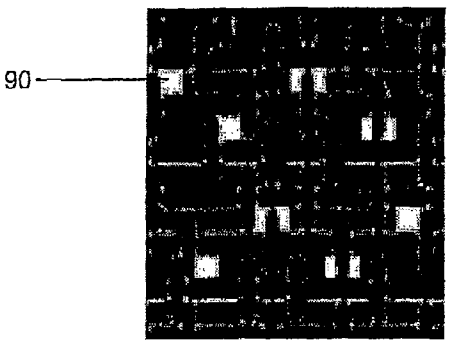

Careful inspection of FIG. 15 shows that the resistance to impingement drainage comes from both the paper side layer 52 as shown in FIG. 12, and the centre plane as shown in FIG. 13. When the drainage areas of these two contributing features are combined, as shown in FIG. 15, the resulting drainage area is quite low, in this case approximately 16%. The fabrics of the invention having these qualities therefore resist impingement drainage, and allow better formation in the incipient paper web on the paper side surface 54 of the paper side layer 52, because the combined first and third drainage areas, i.e. in the paper side layer 52 and at the centre plane, will serve to slow down the rate of flow of the stock through the paper side layer 52.

Referring now to FIGS. 16 to 19, a comparison can be made between the fabrics of the invention and similar fabrics of the prior art.

Figure 17:
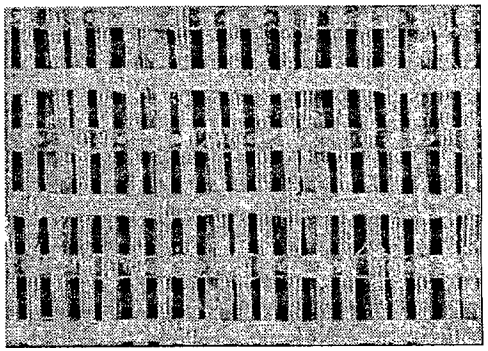
FIG. 17 PRIOR ART
FIGS. 16 and 17 are photographs of the respective paper side surface and machine side surface of a fabric of the prior art.
Figure 16:
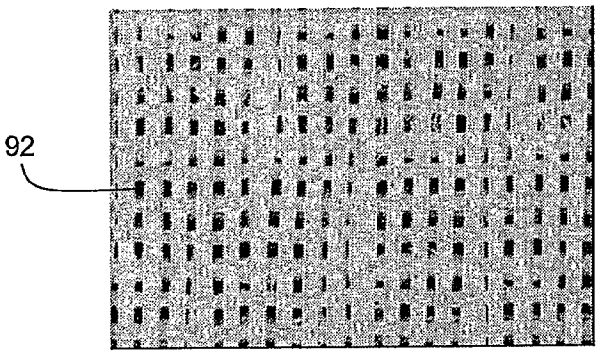
FIG. 16 PRIOR ART

FIGS. 16 and 17 are photographs showing the paper side and machine side layers respectively of a fabric of the prior art. The high drainage areas of the fabric, comprised by the open areas 92, can be clearly seen.

Figure 19:
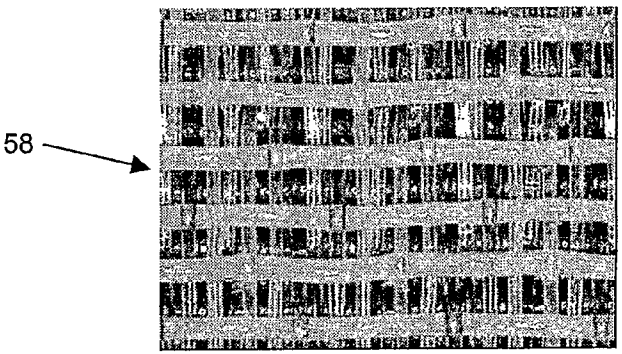
FIGS. 18 and 19 are photographs of the respective paper side surface and machine side surface of a fabric of the invention.
Figure 18:
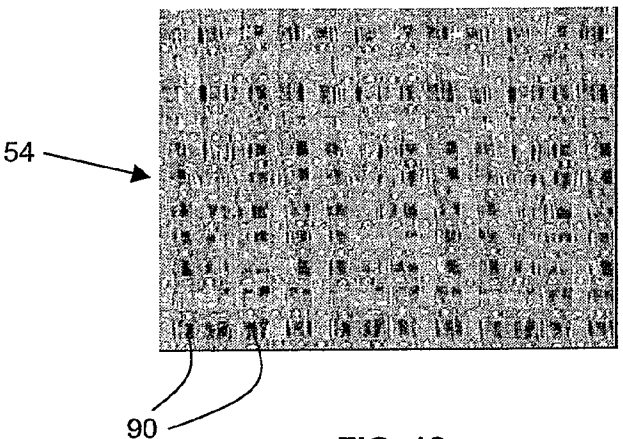

FIGS. 18 and 19 are photographs showing the paper side layer 52 and machine side layer 56 of a fabric of the invention. Each of these photographs shows dramatically that although the weave patterns appear similar from the surfaces of this fabric and the fabric shown in FIGS. 16 and 17, the fabric of FIGS. 18 and 19 has a substantially reduced straight through drainage area of the fabric, as evidenced by the relatively few open areas 90.

It can thus be seen that the fabrics of this invention provide relatively little straight through drainage, due to the presence of the binder yarns in the centre plane of the fabric. These yarns fill the centre plane of the fabric so that drainage areas of from 8% to 20% are provided, in significant contrast to the higher drainage areas of the paper side layer and machine side layer. This tends to resist the initial impingement pressures of the stock jet, thus retarding drainage and providing improved formation.

Three samples of the fabrics of the invention were made, using warp binder yarns of polyethylene naphthalate (PEN), having a diameter of 0.12 mm, 0.15 mm and 0.15 mm respectively, and a plain weave pattern for the paper side layer. The weft yarns for both the paper side layer and the machine side layer were of polyethylene teraphthalate (PET), of the dimensions indicated in the table below. The following characteristics were observed:

| | Fabric 1 | Fabric 2 | Fabric 3 |
|---|---|---|---|
| Warp yarns (mm.) | 0.15 PEN | 0.15 PEN | 0.12 PEN |
| PS weft yarns (mm.) | 0.13 | 0.13 | 0.13 |
| MS weft yarns (mm.) | 0.25 | 0.25 | 0.22 |
| Frames/in$^2$ | 6,552 | 6,624 | 10,800 |
| FSI | 156 | 157 | 200 |
| Elastic modulus (pli) | 8,770 | 9,050 | 7,000 |
| Caliper (in.) | 0.0245 | 0.0276 | 0.025 |

The woven samples show that, as the warp yarn diameter is reduced from 0.15 to 0.12 mm, it is possible to increase the number of frames/in$^2$ to as high as 10,800, which is very high especially when compared with more conventional triple layer fabric structures (e.g. those with intrinsic weft binder yarns) which normally will have about 8,000 frames/in$^2$. The large number of frames provides rapid drainage of the sheet to the interior of the fabric. This promotes good sheet formation and fines retention as well as easy passage of air through the paper side surface which improves the rate of drying of the sheet in the forming section. In addition, the high number of frames is accompanied by a correspondingly high FSI value which may be over 200, indicating good sheet support. This in turn reduces fiber "plugging" and sheet sealing, making the sheet easy to remove from the fabric at the pick-up point. Finally, the fabrics of this invention can be woven so as to be very thin, in the range of about 0.025 in. (0.64 mm) thickness (caliper). This further promotes good sheet properties, and reduces the water carrying capacity of the fabrics, which in turn improves their cleanliness when used in a twin fabric forming environment, in that less water will be thrown off where the line of fabric travel is diverted from a straight line run such as at a roll.

Those skilled in the art will realize that this invention is not limited to the paper and machine side layer weave pattern combinations illustrated here. Generally speaking, the weave pattern of the paper side surface can be selected from: a plain weave, a twill, a broken twill or a basket weave woven using one of 2, 3, 4 or 5 sheds on the loom. The machine side weave can be a twill, broken twill, satin or an N×2N pattern where N is the number of warp yarns in the pattern repeat and 2N is the number of weft yarns, and N is >3. Thus, suitable machine side weave patterns for use in the fabrics of this invention can be those woven according to 4, 5, 6, 8, 10 and 12-shed patterns, but the invention is not so restricted.

Preferably, the fabrics of the invention are constructed using a high modulus polymer monofilament material for the binder yarns, most preferably either polyethylene teraphthalate (PET) or polyethylene naphthalate (PEN). The paper side layer yarns are preferably of PET, and the machine side layer yarns are preferably of PET, nylon, or a blend of PET and polyurethane as described in U.S. Pat. Nos. 5,169,711 and 5,502,120.

The invention claimed is:

1. A double layer forming fabric for a papermaking machine woven to an overall repeating weave pattern requiring at least 8 sheds in the loom and comprising in combination a paper side layer having a first drainage area and a paper side surface, a machine side layer having a second drainage area, and a centre plane within the fabric, defined as a notional plane substantially parallel to and located between the paper side layer and the machine side layer and having a third drainage area, and wherein the fabric has at least (i) paper side layer yarns and machine side layer yarns each oriented in a first direction; and (ii) a set of yarns comprising only pairs of binder yarns interwoven with the paper side layer yarns and machine side layer yarns in a direction transverse to the first direction, wherein:

(a) in the paper side surface, each pair of binder yarns occupies a single combined path;

(b) the pairs of binder yarns are woven in the overall repeating weave pattern such that for each pair:

(A) in a first segment of the single combined path, a first member of the pair interweaves with selected paper side layer yarns at an interweaving location, and a second member of the pair interlaces with at least one machine side layer yarn at an interlacing location;

(B) in a second segment of the single combined path, the second member of the pair interweaves with selected paper side layer yarns at an interweaving location, and the first member of the pair interlaces with at least one machine side layer yarn;

(C) the length of the first and second segments may be equal or unequal;

(D) between each adjacent segment the members exchange positions at an exchange point, and the members are laterally displaced in relation to each other along the single combined path at and between each consecutive exchange point; and (E) for each member of each pair of binder yarns, between each interweaving location and an immediately subsequent interlacing location, and between each interlacing location and an immediately subsequent interweaving location, the member floats between the paper side layer yarns and the machine side layer yarns under at least four paper side layer yarns;

(c) the machine side layer is woven to a repeating machine side layer weave pattern in which, for each pair of binder yarns, in each repeat the first member and the second member alternately interlace with selected machine side layer yarns but do not form a complete repeat of the machine side layer weave pattern; and (d) the fabric has a total warp fill after heatsetting of at least 100%

(e) the first drainage area is between 25% and 50%;

(f) the second drainage area is between 25% and 50%; and (g) the third drainage area is between 8% and 20%.

2. A double layer forming fabric as claimed in claim 1 wherein in a cross-section of the fabric in the transverse direction, each paper side layer yarn is laterally displaced from proximate machine side layer yarns.

3. A double layer forming fabric as claimed in claim 1 wherein the binder yarns occupy at least 80% of the centre plane in each repeat of the overall repeating weave pattern.

4. A double layer forming fabric as claimed in any of claims 1, 2 or 3 wherein in each repeat of the repeating weave pattern a ratio of the number of paper side layer yarns and the number of machine side layer yarns is selected from 3:1, 3:2, 2:1 and 1:1.

5. A double layer forming fabric as claimed in claim 4 wherein the ratio is 3:2.

6. A double layer forming fabric as claimed in claim 1 or claim 3 wherein the paper side layer yarns and machine side layer yarns are wefts and the binder yarns are warps.

7. A double layer forming fabric as claimed in claim 1 or claim 3 wherein the paper side layer yarns and machine side layer yarns are warps and the binder yarns are wefts.

8. A double layer forming fabric as claimed in any preceding claim wherein the machine side layer is woven to a pattern selected from a 6-shed satin, a 12-shed satin, a twill and an N×2N pattern, in which N is the number of sheds in the loom.

9. A double layer forming fabric as claimed in claim 8 wherein the machine side layer is woven to an N×2 N pattern.

10. A double layer forming fabric as claimed in any preceding claim wherein the paper side layer is woven to a pattern selected from a plain weave, a 3-shed twill, a 3-shed satin, a 4-shed twill and a 4-shed satin.

11. A double layer forming fabric as claimed in any of claims 1 to 7 wherein the overall repeating weave pattern requires 24 sheds.

12. A double layer forming fabric as claimed in claim 1 or claim 3 wherein the third drainage area is between 8% and 15%.

13. A double layer forming fabric as claimed in claim 1 wherein the binder yarns are constructed of a monofilament material selected from polyethylene naphthalate and polyethylene terephthalate.

14. A double layer forming fabric as claimed in claim 13 wherein the monofilament material is polyethylene naphthalate.

15. A double layer forming fabric as claimed in claim 1 wherein the machine side layer yarns are constructed of a monofilament material selected from nylon, polyethylene terephthalate and a blend of polyethylene terephthalate and polyurethane.

16. A double layer forming fabric for a papermaking machine woven to an overall repeating weave pattern requiring at least 8 sheds in the loom and comprising in combination a paper side layer having a paper side surface, and a machine side layer, the fabric having at least (i) paper side layer yarns and machine side layer yarns each oriented in a first direction; and (ii) a set of yarns comprising only pairs of binder yarns interwoven with the paper side layer yarns and machine side layer yarns in a direction transverse to the first direction, wherein:

(a) in the paper side surface, each pair of binder yarns occupies a single combined path;

(b) the pairs of binder yarns are woven in the overall repeating weave pattern such that for each pair:

(A) in a first segment of the single combined path, a first member of the pair interweaves with selected paper side layer yarns at an interweaving location, and a second member of the pair interlaces with at least one machine side layer yarn at an interlacing location;

(B) in a second segment of the single combined path, the second member of the pair interweaves with selected paper side layer yarns at an interweaving location, and the first member of the pair interlaces with at least one machine side layer yarn;

(C) the length of the first and second segments may be equal or unequal;

(D) between each adjacent segment the members exchange positions at an exchange point, and the members are laterally displaced in relation to each other along the single combined path at and between each consecutive exchange point; and (E) for each member of each pair of binder yarns, between each interweaving location and an immediately subsequent interlacing location, and between each interlacing location and an immediately subsequent interweaving location, the member floats between the paper side layer yarns and the machine side layer yarns under at least four paper side layer yarns;

(c) the machine side layer is woven to a repeating machine side layer weave pattern in which, for each pair of binder yarns, in each repeat the first member and the second member alternately interlace with selected machine side layer yarns but do not form a complete repeat of the machine side layer weave pattern; and (d) the fabric has a total warp fill after heatsetting of at least 100%.

17. A double layer forming fabric as claimed in claim 11 wherein in a cross-section of the fabric in the transverse direction, each paper side layer yarn is laterally displaced from proximate machine side layer yarns.

18. A double layer forming fabric as claimed in claim 16 or claim 17 wherein in each repeat of the repeating weave pattern a ratio of the number of paper side layer yarns and the number of machine side layer yarns is selected from 3:1, 3:2, 2:1 and 1:1.

19. A double layer forming fabric as claimed in claim 18 wherein the ratio is 3:2.

20. A double layer forming fabric as claimed in claim 16 or claim 17 wherein the paper side layer yarns and machine side layer yarns are wefts and the binder yarns are warps.

21. A double layer forming fabric as claimed in claim 16 or claim 17 wherein the paper side layer yarns and machine side layer yarns are warps and the binder yarns are wefts.

22. A double layer forming fabric as claimed in any of claims 16 to 21 wherein the machine side layer is woven to a pattern selected from a 6-shed satin, a 12-shed satin, a twill and an N×2N pattern, in which N is the number of sheds in the loom.

23. A double layer forming fabric as claimed in claim 22 wherein the machine side layer is woven to an N×2 N pattern.

24. A double layer forming fabric as claimed in any of claims 16 to 23 wherein the paper side layer is woven to a pattern selected from a plain weave, a 3-shed twill, a 3-shed satin, a 4-shed twill and a 4-shed satin.

25. A double layer forming fabric as claimed in any of claims 16 to 21 wherein the overall repeating weave pattern requires 24 sheds.

26. A double layer forming fabric as claimed in claim 16 wherein the binder yarns are constructed of a monofilament material selected from polyethylene naphthalate and polyethylene terephthalate.

27. A double layer forming fabric as claimed in claim 26 wherein the monofilament material is polyethylene naphthalate.

28. A double layer forming fabric as claimed in claim 16 wherein the machine side layer yarns are constructed of a monofilament material selected from nylon, polyethylene terephthalate and a blend of polyethylene terephthalate and polyurethane.

* * * * *

UNITED STATES PATENT AND TRADEMARK OFFICE

CERTIFICATE OF CORRECTION

PATENT NO. : 7,426,944 B2
APPLICATION NO. : 11/575990
DATED : September 23, 2008
INVENTOR(S) : Danby et al.

It is certified that error appears in the above-identified patent and that said Letters Patent is hereby corrected as shown below:

At column 3, line 40, after "US", delete "2004/0020621", and insert therefor --2003/0217782--.
At column 8, line 48, after the sentence ending with the word "yarns" insert --Preferably, the binder yarns are warp yarns.--.
At column 12, line 19, after the word "pass", delete "either".
At column 12, line 19, after "together," delete "or with from 1 to 2 intervening warp yarns,".
At column 12, line 21, after "yarns." insert --Alternatively, there may be 1 or 2 warp yarns located between the two yarns forming the double warp knuckles.--.
At column 12, line 22, delete "Alternatively" and insert therefor --As a further alternative--.
At column 12, line 24, after the word "As", insert --yet--.
In claim 1, at column 16, line 37, after the word "and", insert --the--.
In claim 1, at column 16, line 40, after the word "each", delete "pair", and insert therefor --of the pairs--.
In claim 1, at column 16, line 45, after the word "selected", insert --ones of the--.
In claim 1, at column 16, line 47, after the word "one", insert --of the--.
In claim 1, at column 16, line 50, after the word "selected", insert --ones of the--.
In claim 1, at column 16, line 52, after the word "one", insert --of the--.
In claim 1, at column 16, line 53, after the word "layer", delete "yarn", and insert therefor --yarns--.
In claim 1, at column 16, line 54, before the word "length", delete "the", and insert therefor --a--.
In claim 1, at column 16, line 61, after the words "for each", delete "member", and insert therefor --of the members--.
In claim 1, at column 16, line 61, after the words "of each", delete "pair" and insert therefor --of the pairs--.
In claim 1, at column 16, line 62, after the word "each" insert --of the--.
In claim 1, at column 16, line 63, after the word "subsequent" insert --one of the--.
In claim 1, at column 16, line 63, after the word "interlacing", delete "location", and insert therefor --locations--.
In claim 1, at column 16, line 63, after the word "each", insert --of the--.
In claim 1, at column 16, line 64, after the word "subsequent", insert --one of the--.
In claim 1, at column 16, line 65, before the words "the member", delete "location," and insert therefor --locations,--.
In claim 1, at column 16, line 66, after the word "four", insert --of the--.
In claim 1, at column 17, line 2, after the word "each", delete "pair", and insert therefor --of the pairs--.

UNITED STATES PATENT AND TRADEMARK OFFICE

CERTIFICATE OF CORRECTION

PATENT NO. : 7,426,944 B2
APPLICATION NO. : 11/575990
DATED : September 23, 2008
INVENTOR(S) : Danby et al.

It is certified that error appears in the above-identified patent and that said Letters Patent is hereby corrected as shown below:

In claim 1, at column 17, line 4, after the word "selected", insert --ones of the--.
In claim 2, at column 17, line 12, after "claim 1", insert --,--.
In claim 2, at column 17, line 14, after the word "each", insert --of the--.
In claim 2, at column 17, line 14, after the word "layer", delete "yarn", and insert therefor --yarns--.
In claim 2, at column 17, line 15, after the word "proximate", insert --ones of the--.
In claim 3, at column 17, line 16, after "claim 1", insert --,--.
In claim 4, at column 17, line 19, after the word "in", delete "any of claims 1, 2 or 3", and insert therefor --Claim 1,--.
In claim 4, at column 17, line 21, after the words "number of", insert --the--.
In claim 4, at column 17, line 22, after the word "of", insert --the--.
In claim 6, at column 17, line 26, after "claim 1", insert --,--.
In claim 6, at column 17, line 26, after "claim 1", delete "or claim 3".
In claim 6, at column 17, line 27, after the word "and", insert --the--.
In claim 7, at column 17, line 29, after "claim 1", insert --,--.
In claim 7, at column 17, line 29, after "claim 1", delete "or claim 3".
In claim 7, at column 17, line 30, after the word "and", insert --the--.
In claim 8, at column 17, line 32, after the word "in", delete "any preceding claim" and insert therefor --Claim 1,--.
In claim 8, at column 17, line 35, after the word "is", delete "the", and insert therefor --a--.
In claim 9, at column 17, line 36, after "claim 8", insert --,--.
In claim 10, at column 17, line 38, after the word "in", delete "any preceding claim", and insert therefor --Claim 1,--.
In claim 11, at column 17, line 42, after the word "in", delete "any of claims 1 to 7", and insert therefor --Claim 1,--.
In claim 12, at column 17, line 45, after "claim 1", insert --,--.
In claim 12, at column 17, line 45, after "claim 1", delete "or claim 3".
In claim 13, at column 17, line 48, after "claim 1", insert --,--.
In claim 14, at column 17, line 52, after "claim 13", insert --,--.
In claim 15, at column 17, line 55, after "claim 1", insert --,--.
In claim 16, at column 17, line 62, after the words "sheds in", delete "the", and insert therefor --a--.
In claim 16, at column 18, line 2, after the word "and", insert --the--.
In claim 16, at column 18, line 5, after the word "each", delete "pair", and insert therefor --of the pairs--.
In claim 16, at column 18, line 10, after the word "selected", insert --ones of the--.

UNITED STATES PATENT AND TRADEMARK OFFICE

CERTIFICATE OF CORRECTION

PATENT NO. : 7,426,944 B2
APPLICATION NO. : 11/575990
DATED : September 23, 2008
INVENTOR(S) : Danby et al.

It is certified that error appears in the above-identified patent and that said Letters Patent is hereby corrected as shown below:

In claim 16, at column 18, line 12, after the word “one”, insert --of the--.
In claim 16, at column 18, line 15, after the word “selected”, insert --ones of the--.
In claim 16, at column 18, line 17, after the word “one”, insert --of the--.
In claim 16, at column 18, line 18, after the word “layer”, delete “yarn”, and insert therefor --yarns--.
In claim 16, at column 18, line 19, before the word “length”, delete “the”, and insert therefor --a--.
In claim 16, at column 18, line 26, after the words “for each”, delete “member”, and insert therefor --of the members--.
In claim 16, at column 18, line 26, after the words “of each”, delete “pair”, and insert therefor --of the pairs--.
In claim 16, at column 18, line 27, after the word “each”, insert --of the--.
In claim 16, at column 18, line 27, after the word “interweaving”, delete “location”, and insert therefor --locations--.
In claim 16, at column 18, line 28, after the word “subsequent”, insert --one of the--.
In claim 16, at column 18, line 28, after the word “interlacing”, delete “location”, and insert therefor --locations--.
In claim 16, at column 18, line 28, after the word “each”, insert --of the--.
In claim 16, at column 18, line 29, before the word “and”, delete “location”, and insert therefor --locations--.
In claim 16, at column 18, line 29, after the word “subsequent”, insert --one of the--.
In claim 16, at column 18, line 30, before the words “the member”, delete “location,”, and insert therefor --locations--.
In claim 16, at column 18, line 31, after the word “four”, insert --of the--.
In claim 16, at column 18, line 34, after the word “each”, delete “pair”, and insert therefor --of the pairs--.
In claim 16, at column 18, line 36, after the word “selected”, insert --ones of the--.
In claim 17, at column 18, line 41, after the word “claim”, delete “11”, and insert therefor --16,--.
In claim 17, at column 18, line 43, after the word “each”, insert --of the--.
In claim 17, at column 18, line 43, after the word “layer”, delete “yarn”, and insert therefor --yarns--.
In claim 17, at column 18, line 44, after the word “proximate”, insert --ones of the--.
In claim 18, at column 18, line 45, after “claim 16”, insert --,--.
In claim 18, at column 18, line 45, after “claim 16”, delete “or claim 17”.
In claim 18, at column 18, line 47, after the word “of”, insert --the--.
In claim 18, at column 18, line 48, after the word “of”, insert --the--.

UNITED STATES PATENT AND TRADEMARK OFFICE

CERTIFICATE OF CORRECTION

PATENT NO. : 7,426,944 B2
APPLICATION NO. : 11/575990
DATED : September 23, 2008
INVENTOR(S) : Danby et al.

It is certified that error appears in the above-identified patent and that said Letters Patent is hereby corrected as shown below:

In claim 19, at column 18, line 50, after “claim 18”, insert --,--.
In claim 20, at column 18, line 52, after “claim 16”, insert --,--.
In claim 20, at column 18, line 52, after “claim 16” delete “or claim 17”.
In claim 20, at column 18, line 53, after the word “and”, insert --the--.
In claim 21, at column 18, line 55, after “claim 16”, insert --,--.
In claim 21, at column 18, line 55, after “claim 16”, delete “or claim 17”.
In claim 21, at column 18, line 56, after the word “and”, insert --the--.
In claim 22, at column 18, line 58, after the word “in”, delete “any of claims 16 to 21”, and insert therefor --claim 16--.
In claim 23, at column 18, line 63, after “claim 22”, insert --,--.
In claim 24, at column 18, line 65, after the word “in”, delete “any of claims 16 to 23”, and insert therefor --claim 16,--.
In claim 25, at column 19, line 3, after the word “in”, delete “any of claims 16 to 21”, and insert therefor --claim 16,--.
In claim 26, at column 19, line 6, after “claim 16”, insert --,--.
In claim 27, at column 19, line 1, after “claim 26”, insert --,--.
In claim 28, at column 19, line 4, after “claim 16”, insert --,--.

Signed and Sealed this

Twenty-third Day of June, 2009

John Doll

JOHN DOLL
*Acting Director of the United States Patent and Trademark Office*

UNITED STATES PATENT AND TRADEMARK OFFICE

CERTIFICATE OF CORRECTION

PATENT NO. : 7,426,944 B2
APPLICATION NO. : 11/575990
DATED : September 23, 2008
INVENTOR(S) : Danby et al.

It is certified that error appears in the above-identified patent and that said Letters Patent is hereby corrected as shown below:

At column 3, line 40, after "US", delete "2004/0020621", and insert therefor --2003/0217782--.
At column 8, line 48, after the sentence ending with the word "yarns" insert --Preferably, the binder yarns are warp yarns.--.
At column 12, line 19, after the word "pass", delete "either".
At column 12, line 19, after "together," delete "or with from 1 to 2 intervening warp yarns,".
At column 12, line 21, after "yarns." insert --Alternatively, there may be 1 or 2 warp yarns located between the two yarns forming the double warp knuckles.--.
At column 12, line 22, delete "Alternatively" and insert therefor --As a further alternative--.
At column 12, line 24, after the word "As", insert --yet--.
In claim 1, at column 16, line 37, after the word "and", insert --the--.
In claim 1, at column 16, line 40, after the word "each", delete "pair", and insert therefor --of the pairs--.
In claim 1, at column 16, line 45, after the word "selected", insert --ones of the--.
In claim 1, at column 16, line 47, after the word "one", insert --of the--.
In claim 1, at column 16, line 50, after the word "selected", insert --ones of the--.
In claim 1, at column 16, line 52, after the word "one", insert --of the--.
In claim 1, at column 16, line 53, after the word "layer", delete "yarn", and insert therefor --yarns--.
In claim 1, at column 16, line 54, before the word "length", delete "the", and insert therefor --a--.
In claim 1, at column 16, line 61, after the words "for each", delete "member", and insert therefor --of the members--.
In claim 1, at column 16, line 61, after the words "of each", delete "pair" and insert therefor --of the pairs--.
In claim 1, at column 16, line 62, after the word "each" insert --of the--.
In claim 1, at column 16, line 63, after the word "subsequent" insert --one of the--.
In claim 1, at column 16, line 63, after the word "interlacing", delete "location", and insert therefor --locations--.
In claim 1, at column 16, line 63, after the word "each", insert --of the--.
In claim 1, at column 16, line 64, after the word "subsequent", insert --one of the--.
In claim 1, at column 16, line 65, before the words "the member", delete "location," and insert therefor --locations,--.
In claim 1, at column 16, line 66, after the word "four", insert --of the--.
In claim 1, at column 17, line 2, after the word "each", delete "pair", and insert therefor --of the pairs--.

UNITED STATES PATENT AND TRADEMARK OFFICE

CERTIFICATE OF CORRECTION

PATENT NO. : 7,426,944 B2
APPLICATION NO. : 11/575990
DATED : September 23, 2008
INVENTOR(S) : Danby et al.

It is certified that error appears in the above-identified patent and that said Letters Patent is hereby corrected as shown below:

In claim 1, at column 17, line 4, after the word "selected", insert --ones of the--.
In claim 2, at column 17, line 12, after "claim 1", insert --,--.
In claim 2, at column 17, line 14, after the word "each", insert --of the--.
In claim 2, at column 17, line 14, after the word "layer", delete "yarn", and insert therefor --yarns--.
In claim 2, at column 17, line 15, after the word "proximate", insert --ones of the--.
In claim 3, at column 17, line 16, after "claim 1", insert --,--.
In claim 4, at column 17, line 19, after the word "in", delete "any of claims 1, 2 or 3", and insert therefor --Claim 1,--.
In claim 4, at column 17, line 21, after the words "number of", insert --the--.
In claim 4, at column 17, line 22, after the word "of", insert --the--.
In claim 6, at column 17, line 26, after "claim 1", insert --,--.
In claim 6, at column 17, line 26, after "claim 1", delete "or claim 3".
In claim 6, at column 17, line 27, after the word "and", insert --the--.
In claim 7, at column 17, line 29, after "claim 1", insert --,--.
In claim 7, at column 17, line 29, after "claim 1", delete "or claim 3".
In claim 7, at column 17, line 30, after the word "and", insert --the--.
In claim 8, at column 17, line 32, after the word "in", delete "any preceding claim" and insert therefor --Claim 1,--.
In claim 8, at column 17, line 35, after the word "is", delete "the", and insert therefor --a--.
In claim 9, at column 17, line 36, after "claim 8", insert --,--.
In claim 10, at column 17, line 38, after the word "in", delete "any preceding claim", and insert therefor --Claim 1,--.
In claim 11, at column 17, line 42, after the word "in", delete "any of claims 1 to 7", and insert therefor --Claim 1,--.
In claim 12, at column 17, line 45, after "claim 1", insert --,--.
In claim 12, at column 17, line 45, after "claim 1", delete "or claim 3".
In claim 13, at column 17, line 48, after "claim 1", insert --,--.
In claim 14, at column 17, line 52, after "claim 13", insert --,--.
In claim 15, at column 17, line 55, after "claim 1", insert --,--.
In claim 16, at column 17, line 62, after the words "sheds in", delete "the", and insert therefor --a--.
In claim 16, at column 18, line 2, after the word "and", insert --the--.
In claim 16, at column 18, line 5, after the word "each", delete "pair", and insert therefor --of the pairs--.
In claim 16, at column 18, line 10, after the word "selected", insert --ones of the--.

UNITED STATES PATENT AND TRADEMARK OFFICE

CERTIFICATE OF CORRECTION

PATENT NO. : 7,426,944 B2
APPLICATION NO. : 11/575990
DATED : September 23, 2008
INVENTOR(S) : Danby et al.

It is certified that error appears in the above-identified patent and that said Letters Patent is hereby corrected as shown below:

In claim 16, at column 18, line 12, after the word “one”, insert --of the--.
In claim 16, at column 18, line 15, after the word “selected”, insert --ones of the--.
In claim 16, at column 18, line 17, after the word “one”, insert --of the--.
In claim 16, at column 18, line 18, after the word “layer”, delete “yarn”, and insert therefor --yarns--.
In claim 16, at column 18, line 19, before the word “length”, delete “the”, and insert therefor --a--.
In claim 16, at column 18, line 26, after the words “for each”, delete “member”, and insert therefor --of the members--.
In claim 16, at column 18, line 26, after the words “of each”, delete “pair”, and insert therefor --of the pairs--.
In claim 16, at column 18, line 27, after the word “each”, insert --of the--.
In claim 16, at column 18, line 27, after the word “interweaving”, delete “location”, and insert therefor --locations--.
In claim 16, at column 18, line 28, after the word “subsequent”, insert --one of the--.
In claim 16, at column 18, line 28, after the word “interlacing”, delete “location”, and insert therefor --locations--.
In claim 16, at column 18, line 28, after the word “each”, insert --of the--.
In claim 16, at column 18, line 29, before the word “and”, delete “location”, and insert therefor --locations--.
In claim 16, at column 18, line 29, after the word “subsequent”, insert --one of the--.
In claim 16, at column 18, line 30, before the words “the member”, delete “location,”, and insert therefor --locations--.
In claim 16, at column 18, line 31, after the word “four”, insert --of the--.
In claim 16, at column 18, line 34, after the word “each”, delete “pair”, and insert therefor --of the pairs--.
In claim 16, at column 18, line 36, after the word “selected”, insert --ones of the--.
In claim 17, at column 18, line 41, after the word “claim”, delete “11”, and insert therefor --16,--.
In claim 17, at column 18, line 43, after the word “each”, insert --of the--.
In claim 17, at column 18, line 43, after the word “layer”, delete “yarn”, and insert therefor --yarns--.
In claim 17, at column 18, line 44, after the word “proximate”, insert --ones of the--.
In claim 18, at column 18, line 45, after “claim 16”, insert --,--.
In claim 18, at column 18, line 45, after “claim 16”, delete “or claim 17”.
In claim 18, at column 18, line 47, after the word “of”, insert --the--.
In claim 18, at column 18, line 48, after the word “of”, insert --the--.

UNITED STATES PATENT AND TRADEMARK OFFICE

CERTIFICATE OF CORRECTION

PATENT NO. : 7,426,944 B2
APPLICATION NO. : 11/575990
DATED : September 23, 2008
INVENTOR(S) : Danby et al.

It is certified that error appears in the above-identified patent and that said Letters Patent is hereby corrected as shown below:

In claim 19, at column 18, line 50, after "claim 18", insert --,--.
In claim 20, at column 18, line 52, after "claim 16", insert --,--.
In claim 20, at column 18, line 52, after "claim 16" delete "or claim 17".
In claim 20, at column 18, line 53, after the word "and", insert --the--.
In claim 21, at column 18, line 55, after "claim 16", insert --,--.
In claim 21, at column 18, line 55, after "claim 16", delete "or claim 17".
In claim 21, at column 18, line 56, after the word "and", insert --the--.
In claim 22, at column 18, line 58, after the word "in", delete "any of claims 16 to 21", and insert therefor --claim 16--.
In claim 23, at column 18, line 63, after "claim 22", insert --,--.
In claim 24, at column 18, line 65, after the word "in", delete "any of claims 16 to 23", and insert therefor --claim 16,--.
In claim 25, at column 19, line 3, after the word "in", delete "any of claims 16 to 21", and insert therefor --claim 16,--.
In claim 26, at column 19, line 6, after "claim 16", insert --,--.
In claim 27, at column 20, line 1, after "claim 26", insert --,--.
In claim 28, at column 20, line 4, after "claim 16", insert --,--.

This certificate supersedes the Certificate of Correction issued June 23, 2009.

Signed and Sealed this

Twenty-first Day of July, 2009

John Doll

JOHN DOLL
*Acting Director of the United States Patent and Trademark Office*